US010373789B2

(12) United States Patent
Nakahara

(10) Patent No.: US 10,373,789 B2
(45) Date of Patent: Aug. 6, 2019

(54) ELECTROMAGNETIC RELAY

(71) Applicant: PANASONIC INTELLECTUAL PROPERTY MANAGEMENT CO., LTD., Osaka (JP)

(72) Inventor: Chiharu Nakahara, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 128 days.

(21) Appl. No.: 15/666,718

(22) Filed: Aug. 2, 2017

(65) Prior Publication Data

US 2018/0053614 A1 Feb. 22, 2018

(30) Foreign Application Priority Data

Aug. 16, 2016 (JP) ..... 2016-159642

(51) Int. Cl.

| | |
|---|---|
| ***H01H 9/02*** | (2006.01) |
| ***H01H 50/02*** | (2006.01) |
| ***H01H 50/06*** | (2006.01) |
| ***H01H 50/14*** | (2006.01) |
| ***H01H 50/54*** | (2006.01) |

(52) U.S. Cl.

CPC ..... *H01H 50/023* (2013.01); *H01H 50/06* (2013.01); *H01H 50/14* (2013.01); *H01H 50/54* (2013.01); *H01H 2223/002* (2013.01)

(58) Field of Classification Search

CPC ..... H01H 50/023; H01H 50/54; H01H 50/06; H01H 50/14; H01H 50/642; H01H 50/18; H01H 2223/002

USPC ..... 335/202

See application file for complete search history.

(56) References Cited

U.S. PATENT DOCUMENTS

| | | | | |
|---|---|---|---|---|
| 2,527,475 A * | 10/1950 | Bates | H01H 50/54 | 200/302.1 |
| 4,292,614 A * | 9/1981 | Ono | H01H 50/023 | 335/132 |
| 5,392,015 A * | 2/1995 | Matsuoka | H01H 1/50 | 335/130 |
| 6,116,558 A * | 9/2000 | Yano | H01R 12/7011 | 248/27.3 |
| 8,193,881 B2 * | 6/2012 | Yuba | H01H 9/443 | 335/128 |

(Continued)

FOREIGN PATENT DOCUMENTS

JP 2015-216053 A 12/2015

*Primary Examiner* — Shawki S Ismail
*Assistant Examiner* — Lisa N Homza
(74) *Attorney, Agent, or Firm* — Greenblum & Bernstein, P.L.C.

(57) ABSTRACT

An electromagnetic relay includes a terminal electrically connected to a fixed contact or a movable contact, and a case accommodating a contact point. The terminal includes a terminal piece having at least a portion located outside the case. The case includes a bottom surface section (first peripheral wall section) and a side surface section (second peripheral wall section). The bottom surface section has a gap to be closed with a sealant and an outer surface to which the sealant is applied. The side surface section has a through hole through which the terminal piece is inserted. The case has a flow path along which the sealant applied to the outer surface flows from the outer surface to the through hole.

20 Claims, 22 Drawing Sheets

(56) References Cited

U.S. PATENT DOCUMENTS

| | | | | |
|---|---|---|---|---|
| 2013/0082806 | A1* | 4/2013 | Moriyama | H01H 50/026 335/192 |
| 2014/0225688 | A1* | 8/2014 | Masui | H01H 50/642 335/189 |
| 2015/0325398 | A1 | 11/2015 | Nakahara et al. | |
| 2015/0325399 | A1* | 11/2015 | Kinoshita | H01H 50/641 335/189 |
| 2016/0260563 | A1* | 9/2016 | Shima | H01H 50/023 |
| 2016/0260566 | A1* | 9/2016 | Shima | H01H 50/38 |
| 2016/0300673 | A1* | 10/2016 | Yamagata | H01H 50/18 |
| 2017/0301494 | A1* | 10/2017 | Itoda | H01H 50/38 |
| 2018/0053614 | A1* | 2/2018 | Nakahara | H01H 50/023 |
| 2018/0053615 | A1* | 2/2018 | Nakahara | H01H 50/023 |
| 2018/0061599 | A1* | 3/2018 | Enomoto | H01H 50/06 |
| 2018/0166240 | A1* | 6/2018 | Daikoku | H01H 50/02 |
| 2018/0261414 | A1* | 9/2018 | Fujimura | H01H 50/02 |
| 2018/0294121 | A1* | 10/2018 | Morimura | H01H 51/2227 |
| 2019/0006139 | A1* | 1/2019 | Murakoshi | H01H 50/28 |

* cited by examiner

ELECTROMAGNETIC RELAY

CROSS-REFERENCE TO RELATED APPLICATION

The present application is based upon and claims the benefit of priority of Japanese Patent Application No. 2016-159642, filed on Aug. 16, 2016, the entire contents of which are incorporated herein by reference.

TECHNICAL FIELD

The present disclosure relates to an electromagnetic relay.

BACKGROUND ART

JP 2015-216053 (hereinafter referred to as "Document 1") discloses an electromagnetic relay. In the electromagnetic relay described in Document 1, a terminal piece of a terminal protrudes from a case (including a base and a cover) in a direction orthogonal to a direction in which the cover is placed on a body (the base). In the electromagnetic relay described in Document 1, a sealant is applied so as to seal a gap between a bottom surface section of the body and an opening edge of the cover with the body being covered with the cover.

In the electromagnetic relay described in Document 1, as described above, the terminal piece of the terminal protrudes from the case in the direction orthogonal to the direction in which the cover is placed on the base. Thus, in order to hermetically seal the electromagnetic relay, the sealant has to be applied to and cured at not only a bottom surface of the relay in which the gap between the bottom surface section of the base and the opening edge of the cover is formed but also a side surface of the relay from which the terminal piece of the terminal protrudes. Thus, the sealant has to be repeatedly applied to and cured at the bottom surface of the relay and the side surface of the relay, thereby increasing the number of steps and shortening a time required for the steps.

SUMMARY

In view of the foregoing, one of the objectives of the present disclosure is to provide an electromagnetic relay which enables a reduction of the number of steps and shortening of a time required for the steps.

An electromagnetic relay according to an aspect of the present disclosure includes a contact point, a driver, a case, and a terminal. The contact point includes a fixed contact and a movable contact. The driver is configured to bring the movable contact into contact with the fixed contact and to separate the movable contact from the fixed contact. The terminal is electrically connected to the fixed contact or the movable contact. The case accommodates the contact point and the driver. The terminal includes a terminal piece. The terminal piece has at least a portion located outside the case. The case includes a first peripheral wall section and a second peripheral wall section. The first peripheral wall section has a gap to be closed with a sealant. The first peripheral wall section has an outer surface to which the sealant is to be applied. The second peripheral wall section is a peripheral wall section different from the first peripheral wall section and has a through hole through which the terminal piece is inserted. The case has a flow path along which the sealant applied to the outer surface of the first peripheral wall section flows from the outer surface of the first peripheral wall section to the through hole in the second peripheral wall section.

BRIEF DESCRIPTION OF THE DRAWINGS

The figures depict one or more implementation in accordance with the present teaching, by way of example only, not by way of limitations. In the figures, like reference numerals refer to the same or similar elements.

DETAILED DESCRIPTION

With reference to the drawings, electromagnetic relays according to first to sixth embodiments will be described in detail below.

First Embodiment

Figure 1:
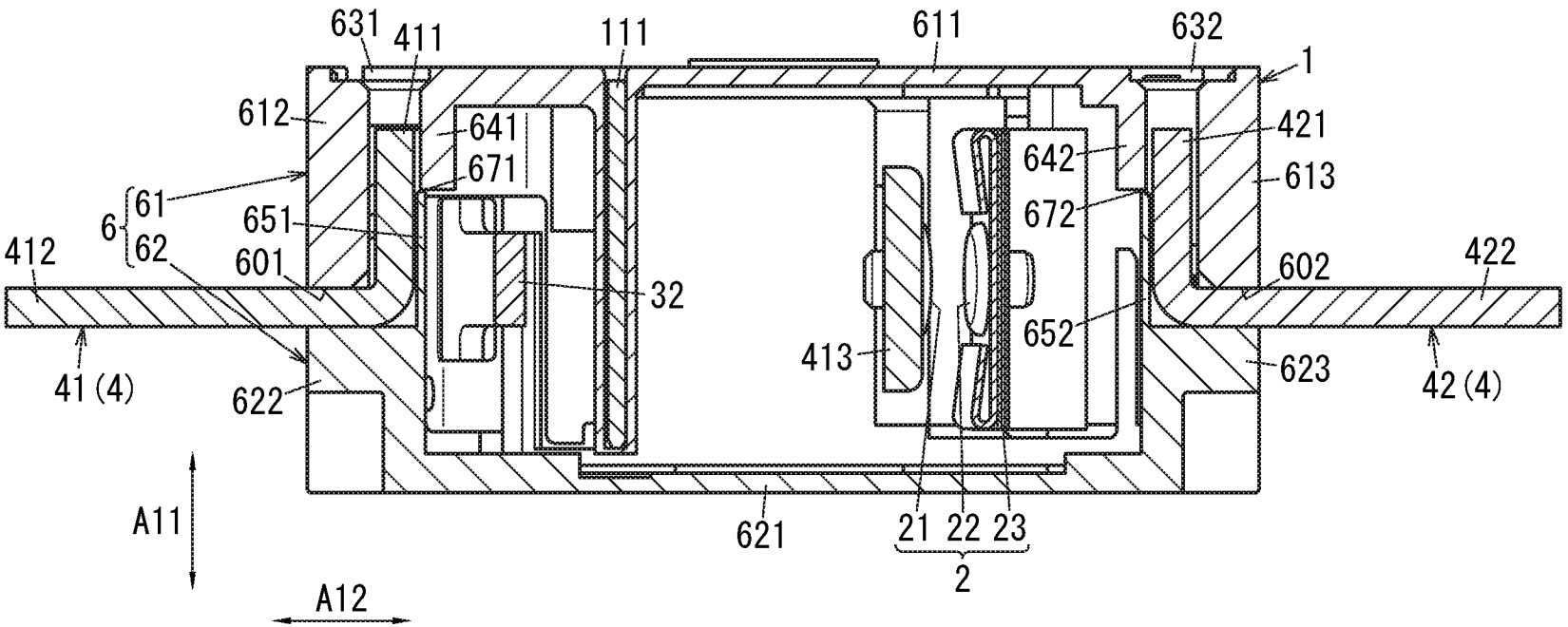
FIG. 1 is a sectional view illustrating an electromagnetic relay according to a first embodiment of the present disclosure.

As illustrated in FIGS. 1 to 4, an electromagnetic relay 1 according to a first embodiment includes a contact point 2, a driver 3, a plurality of (in FIGS. 1 to 4, two) terminals 4, a positioning member 5, a case (external contour) 6, and a plurality of (in FIG. 4, two) connection terminals (coil terminals) 7. FIG. 1 is a sectional view taken along line X1-X1 of FIG. 2.

The electromagnetic relay 1 according to the first embodiment is used in, for example, electric vehicles and electric power charge stations for charging the electric vehicles.

The contact point 2 includes a fixed contact 21, a movable contact 22, and a contact spring 23. The fixed contact 21 is provided to a first terminal 41 which will be described later. The movable contact 22 is brought into contact with the fixed contact 21 and is separated from the fixed contact 21. In other words, the movable contact 22 comes in contact with the fixed contact 21 and separates from the fixed contact 21.

Figure 8:
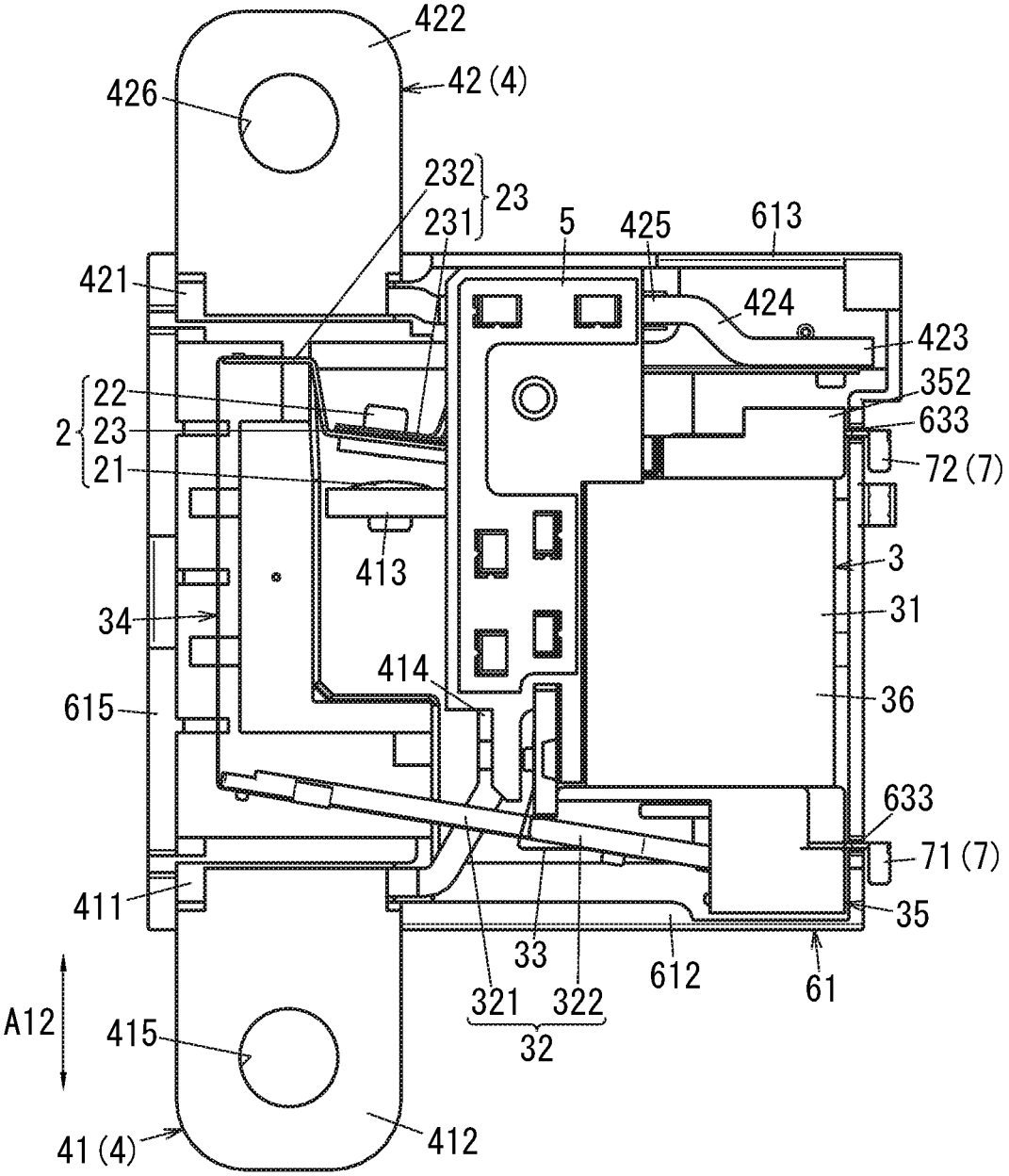
FIG. 8 is a plan view illustrating the electromagnetic relay without the cover.

The contact spring 23 supports the movable contact 22 such that the movable contact 22 can be brought into contact with the fixed contact 21 and can be separated from the fixed contact 21. As illustrated in FIG. 8, the contact spring 23 includes a plurality of (in FIG. 8, three) leaf springs 231 and a coupling member 232. The plurality of leaf springs 231 are integrally bonded in a stacked state. The movable contact 22 is provided to the coupling member 232 to penetrate through the three leaf springs 231 and the coupling member 232. The coupling member 232 is bonded to a card 34 which will be described later. The contact spring 23 is bonded to a second terminal 42 which will be described later via an end of each leaf spring 231.

Figure 4:
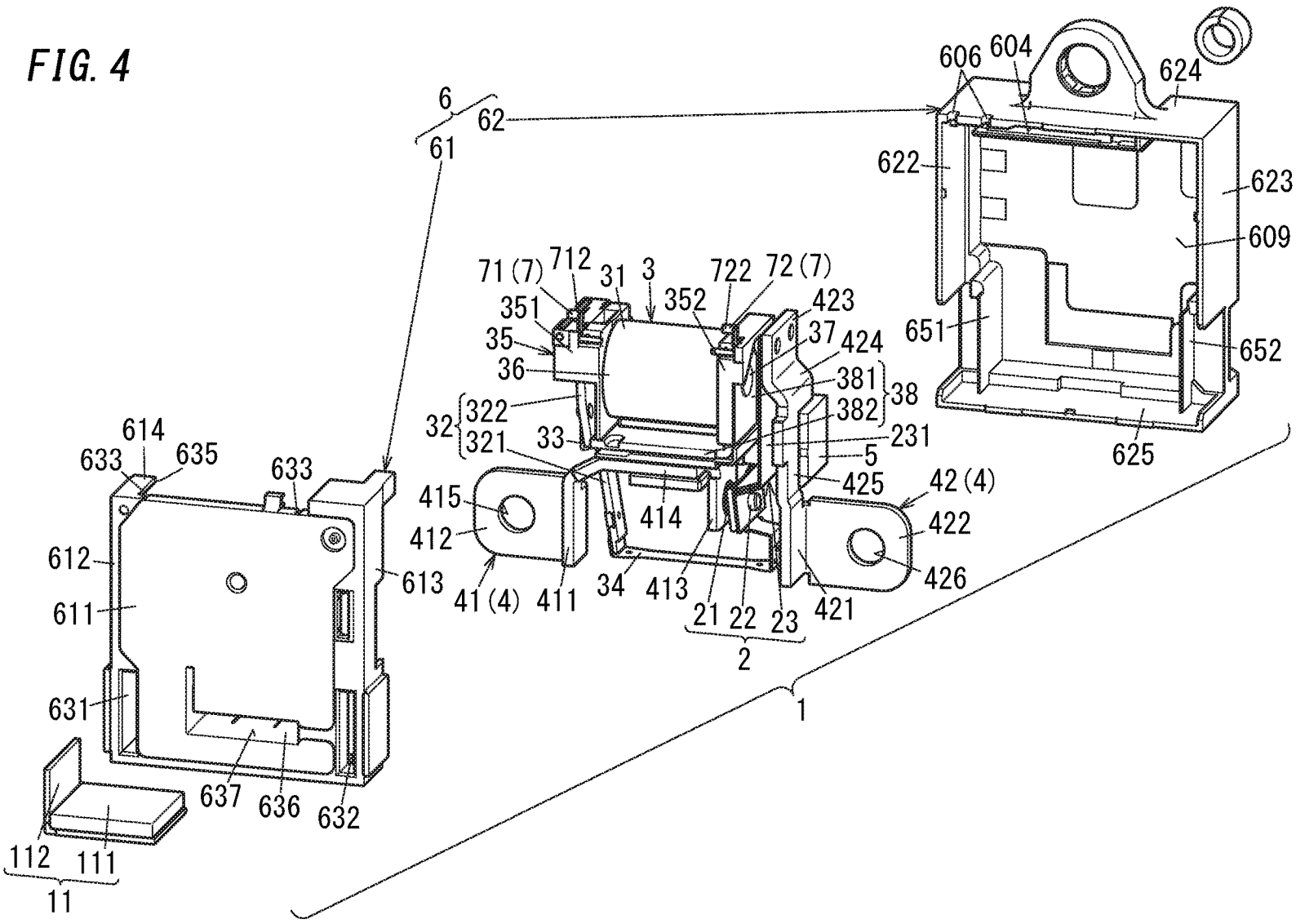
FIG. 4 is an exploded perspective view illustrating the electromagnetic relay.

As illustrated in FIGS. 4 and 8, the driver 3 is configured to bring the movable contact 22 into contact with the fixed contact 21 and to separate the movable contact 22 from the fixed contact 21. The driver 3 includes an electromagnet section 31, an armature 32, a hinge spring 33, and the card 34.

The electromagnet section 31 drives the armature 32. The electromagnet section 31 includes a bobbin 35, a coil 36, an iron core 37, and a yoke 38.

The bobbin 35 includes a body section (not shown), a first flange 351, and a second flange 352. A conductor wire which serves as the coil 36 is wound around the body section. The first flange 351 is provided on a first end side in an axial direction of the body section. The second flange 352 is provided on a second end side in the axial direction of the body section. In the bobbin 35, the body section, the first flange 351, and the second flange 352 are integrally made of an insulative material such as a synthetic resin. The coil 36 is made of a conductor wire (e.g., a copper wire) wound around the bobbin 35. The iron core 37 is disposed at the center of the bobbin 35. The yoke 38 includes a holder piece 381 and a main piece 382. The holder piece 381 is held by the second flange 352. The main piece 382 extends from an end of the holder piece 381 to the first flange 351. The holder piece 381 and the main piece 382 are made of magnetic material and are integrally formed to have an L-shape.

Two connection terminals 7 which are paired are inserted into the respective first and second flanges 351 and 352. The connection terminals 7 in the pair are connected to respective ends of the coil 36. That is, a voltage is applied between the connection terminals 7 in the pair to cause a current to flow through the coil 36, thereby exciting the electromagnet section 31.

The armature 32 includes a driving piece 321 having a strip plate shape and a support piece 322 having a flat plate shape. More specifically, the armature 32 is a magnetic body integrally including the driving piece 321 and the support piece 322. The support piece 322 is wider than the driving piece 321. Moreover, the support piece 322 faces an end of the iron core 37 exposed on an inner bottom surface of the first flange 351. The driving piece 321 protrudes outside the first flange 351 from an open side surface of the first flange 351.

The armature 32 is fixed by the hinge spring 33 to be in contact with the tip of the main piece 382 of the yoke 38. When the electromagnet section 31 is excited, the armature 32 pivots in an orientation in which the support piece 322 approaches the iron core 37 (anticlockwise in FIG. 8) with a portion in contact with the main piece 382 of the yoke 38 being used as a fulcrum, whereas when the electromagnet section 31 is not excited, the armature 32 pivots in an orientation in which the support piece 322 moves away from the iron core 37 (clockwise in FIG. 8).

The hinge spring 33 is a leaf spring. The hinge spring 33 is fixed (fixed by caulking) to the support piece 322 of the armature 32. Moreover, the hinge spring 33 is fixed (fixed by caulking) to the main piece 382 of the yoke 38. The hinge spring 33 has a central portion bent into an L-shape.

The card 34 is configured to couple the contact spring 23 to the armature 32. When the armature 32 pivots, the contact spring 23 is driven via the card 34, and the movable contact 22 is brought into contact with the fixed contact 21 and is separated from the fixed contact 21.

As illustrated in FIGS. 1 to 4, the plurality of terminals 4 include the first terminal 41 and the second terminal 42. The first terminal 41 is electrically connected to the fixed contact 21. The second terminal 42 is electrically connected to the movable contact 22.

The first terminal 41 includes a fixed piece 411, a terminal piece 412, an attachment piece 413, and a coupling piece 414. In the first terminal 41, the fixed piece 411, the terminal piece 412, the attachment piece 413, and the coupling piece 414 are integrally made of a metal material. The fixed piece 411, the attachment piece 413, and the coupling piece 414 are accommodated in the case 6. At least a part of the terminal piece 412 lies outside the case 6. The remaining part of the terminal piece 412 is accommodated in the case 6.

The terminal piece 412 is coupled to the fixed piece 411. The terminal piece 412 extends in a second direction A12 from an end (lower end) of the fixed piece 411 in a first direction A11. The second direction A12 is a direction intersecting the first direction A11. More specifically, the second direction A12 is a direction orthogonal to the first direction A11. The terminal piece 412 has a rectangular flat plate shape. The terminal piece 412 has a central portion through which a screw hole 415 penetrates. A terminal screw (not shown) is screwed into the screw hole 415.

The attachment piece 413 has a rectangular flat plate shape. The attachment piece 413 has a central portion to which the fixed contact 21 is attached. The coupling piece 414 has a rectangular flat plate shape and couples the fixed piece 411 to the attachment piece 413.

The second terminal 42 includes a fixed piece 421, a terminal piece 422, an attachment piece 423, an inclined piece 424, and a coupling piece 425. In the second terminal 42, the fixed piece 421, the terminal piece 422, the attachment piece 423, the inclined piece 424, and the coupling piece 425 are integrally made of a metal material. The fixed piece 421, the attachment piece 423, the inclined piece 424, and the coupling piece 425 are accommodated in the case 6. At least a part of the terminal piece 422 lies outside the case 6. The remaining part of the terminal piece 422 is accommodated in the case 6.

The terminal piece 422 is coupled to the fixed piece 421. The terminal piece 422 extends in the second direction A12 from an end (lower end) of the fixed piece 421 in the first direction A11. The terminal piece 422 has a rectangular flat plate shape. The terminal piece 422 has a central portion through which a screw hole 426 penetrates. A terminal screw (not shown) is screwed into the screw hole 426.

The attachment piece 423 has a rectangular flat plate shape, and each leaf spring 231 of the contact spring 23 is fixed (fixed by caulking) to the attachment piece 423. The inclined piece 424 has a rectangular flat plate shape and protrudes obliquely downward from a lower end of the attachment piece 423. The coupling piece 425 has a rectangular flat plate shape and couples the fixed piece 421 to the inclined piece 424.

The positioning member 5 is configured to limit a mutual positional relationship of the fixed contact 21, the movable contact 22, the contact spring 23, the electromagnet section 31, the armature 32, the card 34, the first terminal 41, and the second terminal 42. The contact point 2 and the driver 3 are accommodated in the case 6 with the electromagnet section 31, the first terminal 41, and the second terminal 42 being held by the positioning member 5.

As illustrated in FIGS. 1 to 4, the case 6 accommodates the contact point 2, the driver 3, and the positioning member 5. The case 6 includes a base (body) 61 and a cover 62.

Figure 5:
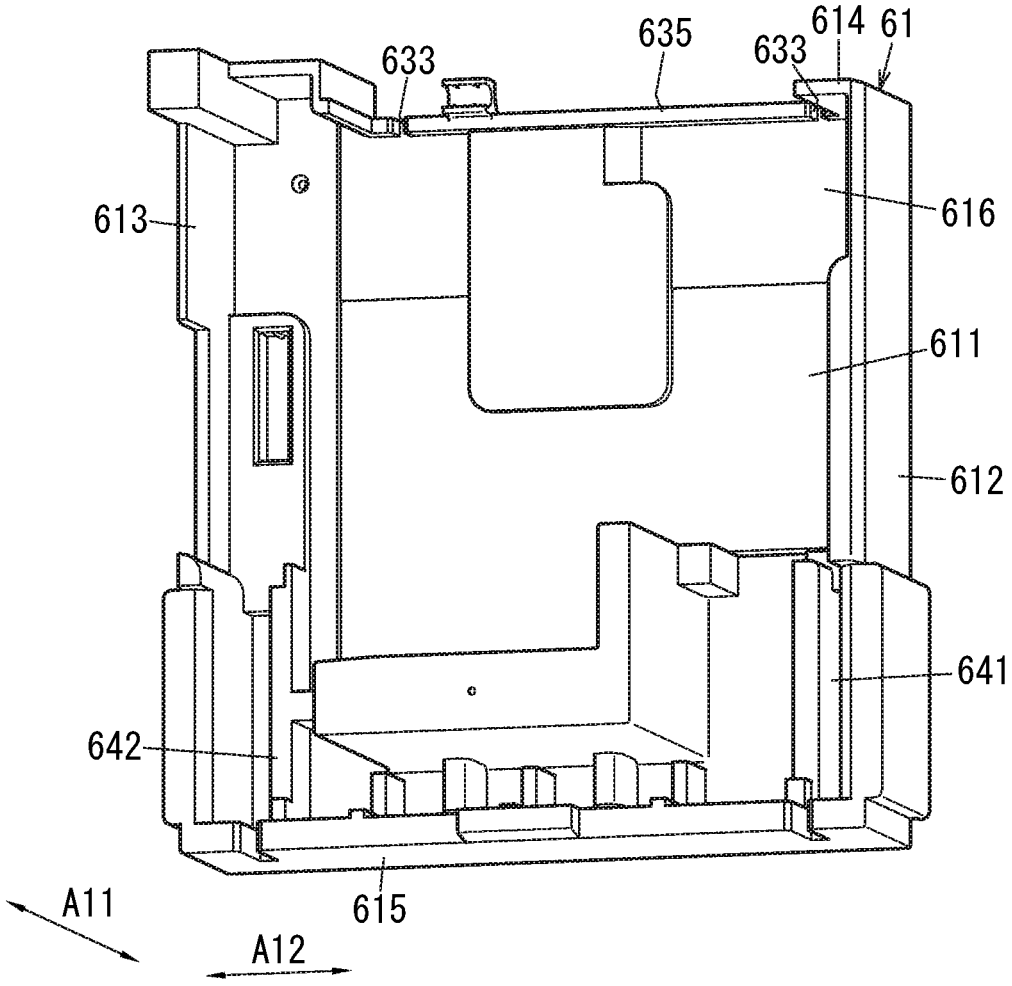
FIG. 5 is a perspective view illustrating a base of the electromagnetic relay.

As illustrated in FIG. 5, the base 61 is a synthetic resin molding product having a rectangular box shape and has an opening 616 in its one surface. More specifically, the base 61 includes a bottom surface section (first peripheral wall section) 611, a pair of side surface sections 612 and 613, and a pair of side surface sections 614 and 615. In the base 61, the bottom surface section 611, the pair of side surface sections 612 and 613, and the pair of side surface sections 614 and 615 are integrally formed.

As illustrated in FIG. 4, the bottom surface section 611 has a plurality of (in FIG. 4, two) holes 631 and 632. More specifically, the holes 631 and 632 having rectangular shapes respectively penetrate at left and right corners of a lower portion of the bottom surface section 611 of the base 61.

As illustrated in FIGS. 1 to 5, and 7, the left hole 631 has an inner peripheral surface including a first wall section 641. The first wall section 641 protrudes from the bottom surface section 611 in the first direction A11. The first wall section 641 faces the side surface section 612 in the second direction A12.

Similarly to the left hole 631, the right hole 632 has an inner peripheral surface including a first wall section 642. The first wall section 642 protrudes from the bottom surface section 611 in the first direction A11. The first wall section 642 faces the side surface section 613 in the second direction A12.

Figure 6:
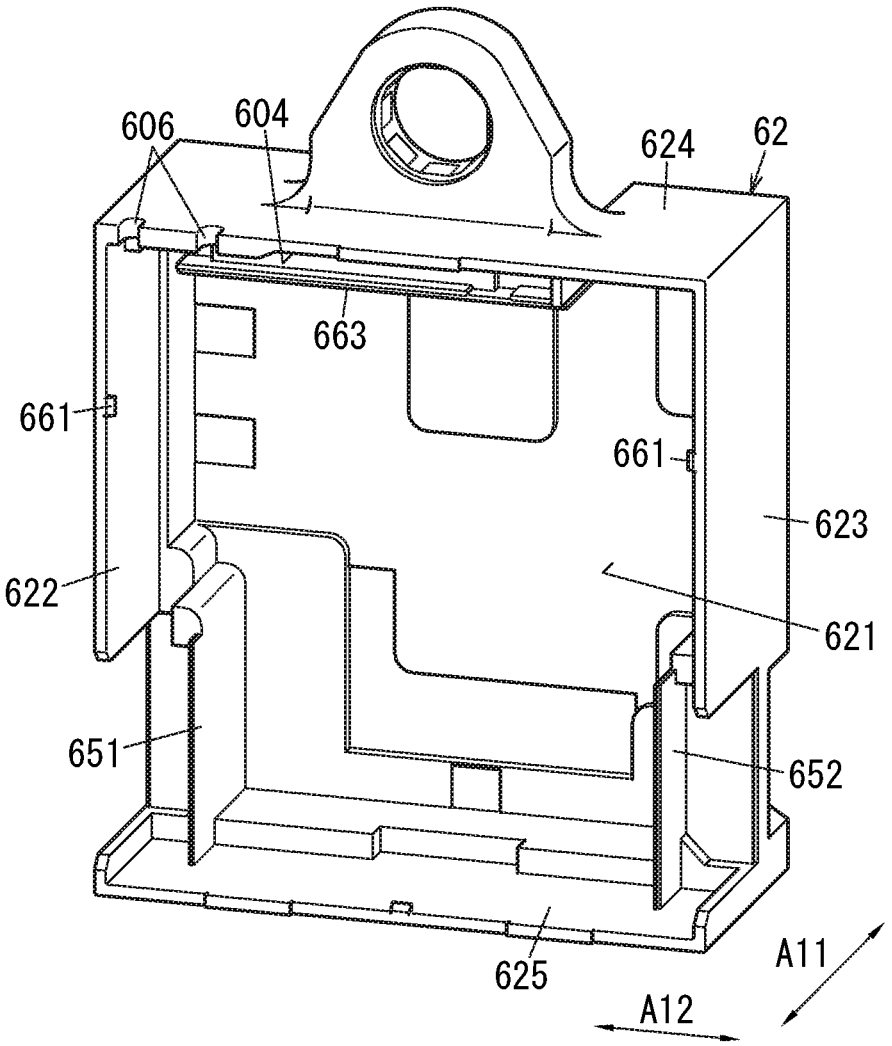
FIG. 6 is a perspective view illustrating a cover of the electromagnetic relay.

The cover 62 covers the opening 616 in the base 61. As illustrated in FIG. 6, the cover 62 is a synthetic resin molding product having a rectangular box shape and having an opening in its one surface. More specifically, the cover 62 includes a bottom surface section 621, a pair of side surface sections 622 and 623, and a pair of side surface sections 624 and 625. In the cover 62, the bottom surface section 621, the pair of side surface sections 622 and 623, and the pair of side surface sections 624 and 625 are integrally formed.

As illustrated in FIGS. 1 to 4, 6, and 7, the cover 62 further includes a pair of second wall sections 651 and 652. The second wall section 651 protrudes from the bottom surface section 621 in the first direction A11. The second wall section 651 faces the side surface section 612 of the base 61 in the second direction A12. The second wall section 652 protrudes from the bottom surface section 621 in the first direction A11. The second wall section 652 faces the side surface section 613 of the base 61 in the second direction A12.

As illustrated in FIG. 6, the cover 62 has an opening edge provided with a pair of projections 661 protruding inwardly. The projections 661 in the pair face each other in the second direction A12.

The opening 616 in the base 61 is covered with the cover 62, thereby assembling the case 6. The pair of projections 661 of the cover 62 is hooked onto the bottom surface section 611 of the base 61, and the cover 62 covers the base 61. In this way, the case 6 is assembled.

Figure 3:
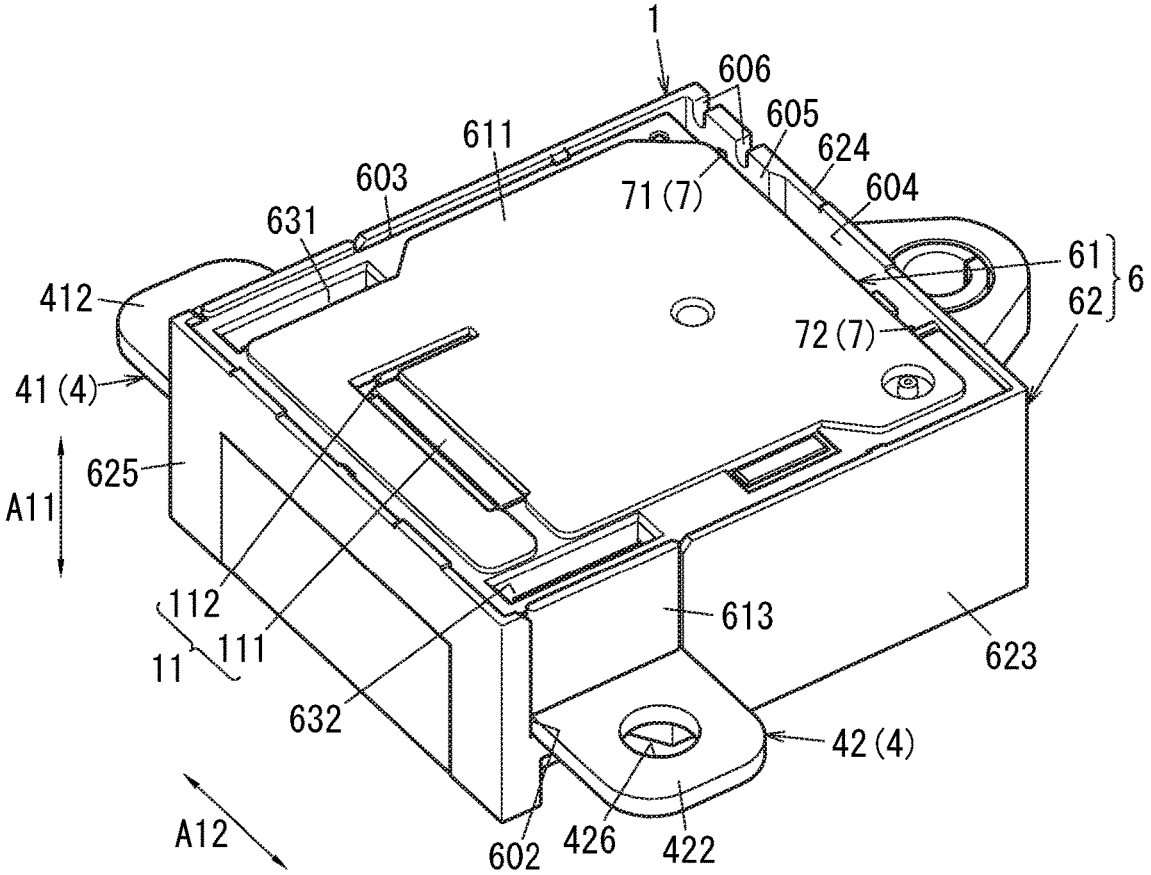
FIG. 3 is a perspective view illustrating the electromagnetic relay.

In a state in which the case 6 is assembled, as illustrated in FIG. 3, a gap 603 is formed between the bottom surface section 611 of the base 61 and the opening edge of the cover 62. In order to hermetically seal the case 6, the gap 603 is closed with a sealant applied to an outer surface of the bottom surface section 611.

Moreover, as illustrated in FIG. 1, in a state in which the case 6 is assembled, a pair of through holes 601 and 602 is formed by the pair of side surface sections 612 and 613 of the base 61 and the pair of side surface sections 622 and 623 of the cover 62. More specifically, the through hole 601 is formed by the side surface section 612 and the side surface section 622, and the through hole 602 is formed by the side surface section 613 and the side surface section 623. The first terminal 41 is inserted through the through hole 601. The second terminal 42 is inserted through the through hole 602. Here, the side surface section 612 and the side surface section 622 correspond to a second peripheral wall section. Similarly, the side surface section 613 and the side surface section 623 also correspond to a second peripheral wall section. That is, the case 6 includes a pair of second peripheral wall sections. The pair of second peripheral wall sections is a peripheral wall section different from the first peripheral wall section and has the through holes 601 and 602 through which the terminal pieces 412 and 422 of the first terminal 41 and the second terminal 42 are inserted.

In a state in which the case 6 is assembled, the fixed piece 411 of the first terminal 41 is exposed through the left hole 631. Moreover, through the right hole 632, the fixed piece 421 of the second terminal 42 is exposed.

Figure 7:
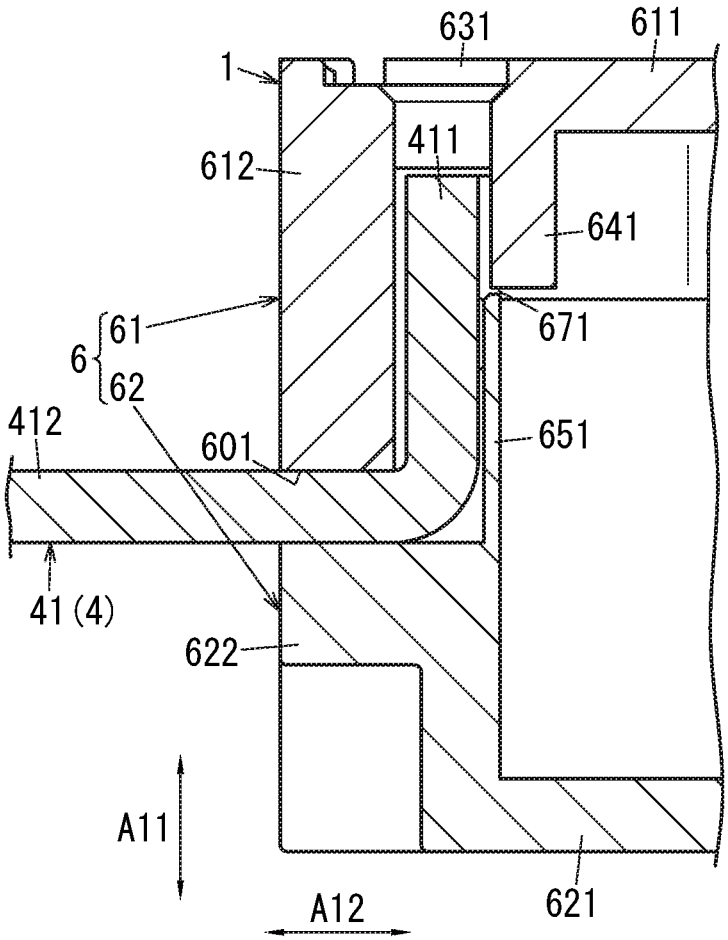
FIG. 7 is a sectional view illustrating a main part of the electromagnetic relay.

In a state in which the case 6 is assembled, the case 6 has flow paths along which the sealant applied to the outer surface of the bottom surface section (first peripheral wall section) 611 flows from the outer surface to the through holes 601 and 602. In the first embodiment, each flow path is formed in the case 6. More specifically, in a state in which the case 6 is assembled, as illustrated in FIGS. 1 and 7, each flow path includes a wall section provided in the case 6. As described above, the base 61 includes the first wall sections 641 and 642 forming the wall section. The cover 62 includes the second wall sections 651 and 652 forming the wall section. In a direction in which the first wall section 641 of the base 61 and the second wall section 651 of the cover 62 protrude (in the first direction A11), the first wall section 641 of the base 61 faces the second wall section 651 of the cover 62 with a gap 671 formed therebetween. Similarly, in a direction in which the first wall section 642 of the base 61 and the second wall section 652 of the cover 62 protrude (in the first direction A11), the first wall section 642 of the base 61 faces the second wall section 652 of the cover 62 with a gap 672 formed therebetween.

In a state in which the case 6 is assembled, a liquid sealant (adhesive agent) is poured into the gap 603 (see FIG. 2) between the bottom surface section 611 of the base 61 and the opening edge of the cover 62. Examples of the sealant include a thermosetting resin. The sealant poured into the gap 603 is cured in the gap 603. Moreover, the liquid sealant applied to the outer surface of the bottom surface section 611 flows into the case 6 through the pair of holes 631 and 632 of the base 61. The liquid sealant poured into the case 6 through the pair of holes 631 and 632 flows along the surfaces of the first wall sections 641 and 642 of the base 61 and the surfaces of the second wall sections 651 and 652 of the cover 62 in the case 6. Then, the sealant is cured in a state of covering the first terminal 41 and the second terminal 42 in the case 6.

According to the above description, the pair of projections 661 of the cover 62 is hooked onto the bottom surface section 611 of the base 61, and the sealant flows in the gap 603 between the bottom surface section 611 of the base 61 and the opening edge of the cover 62 and is cured, so that the base 61 is bonded to the cover 62. Moreover, the sealant flows into the case 6 through the holes 631 and 632 in the base 61 and is cured in a state of covering the first terminal 41 and the second terminal 42 in the case 6, so that the first terminal 41 and the second terminal 42 are fixed to the case 6.

Here, as illustrated in FIGS. 4 and 5, the base 61 includes the side surface section 614 surrounding the accommodation space 609 in which the contact point 2 and the driver 3 are accommodated, and the side surface section 614 has a pair of grooves (through holes) 633 for communication with the interior and the exterior of the accommodation space 609.

Figure 2:
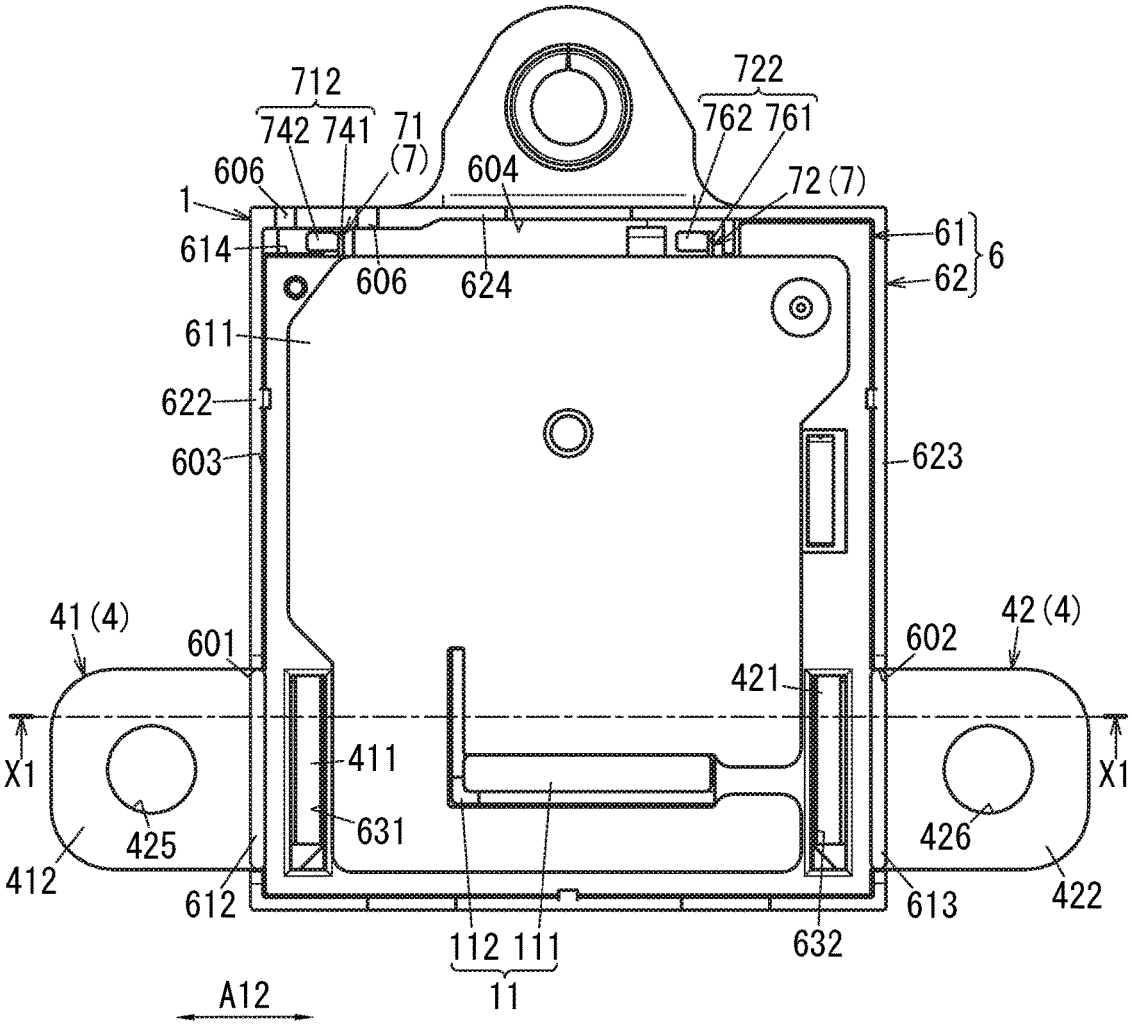
FIG. 2 is a front view illustrating the electromagnetic relay.

As illustrated in FIG. 2, the side surface section 624 of the cover 62 is disposed to leave a space 604 from the side surface section 614 having the grooves 633, and second terminal sections 712 and 722 of a first connection terminal 71 and a second connection terminal 72 lie in the space 604. The space 604 in which the second terminal sections 712 and 722 lie is sealed with a sealant (not shown). Moreover, the cover 62 includes a partition 663 (see FIG. 6) for separating the space 604 from the remaining region in the cover 62.

The case 6 includes an opening surface 605 (see FIG. 3) orthogonal to a direction in which second joint sections 742 and 762 of the plurality of connection terminals 7 are extended. More specifically, the case 6 includes the opening surface 605 orthogonal to a direction in which the plurality of connection terminals 7 are aligned and to a direction in which each connection terminal 7 protrudes. In other words, the opening surface 605 has a normal direction along a direction orthogonal to a direction in which the plurality of connection terminals 7 are aligned and to the direction in which each connection terminal 7 protrudes.

Figure 9:
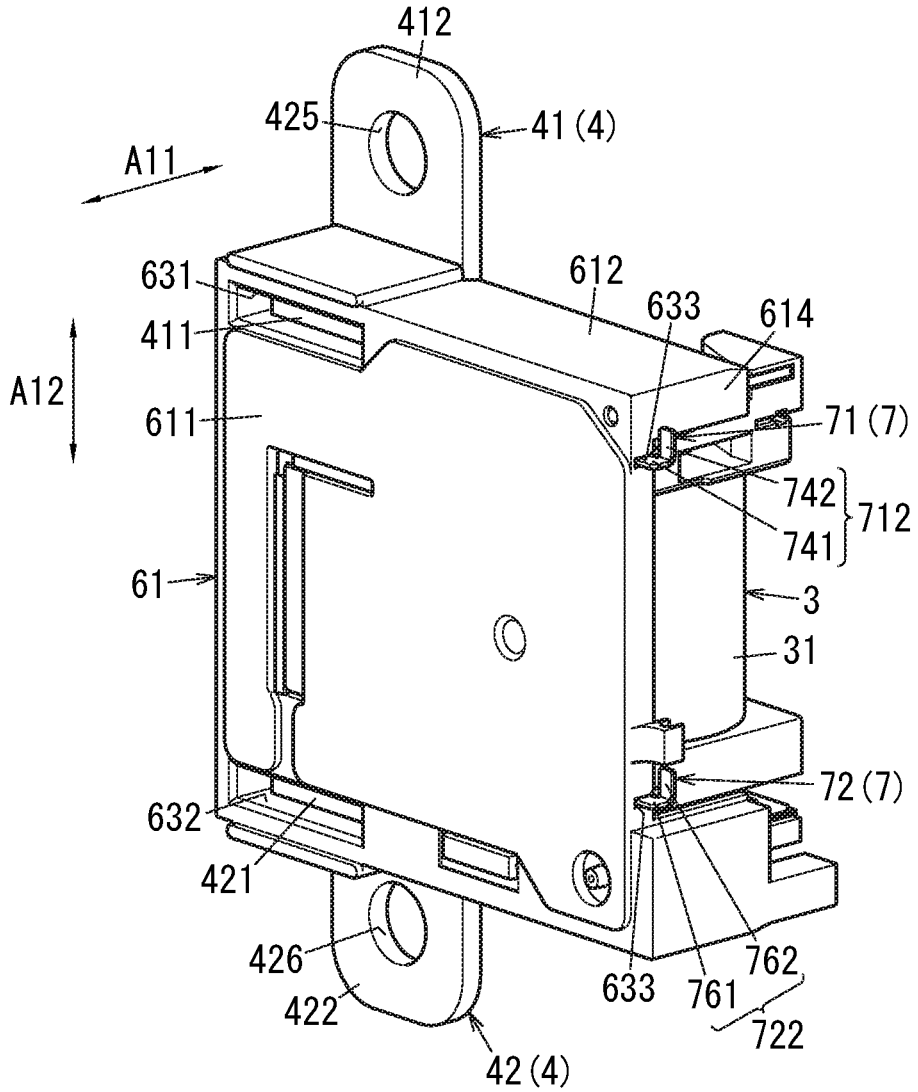
FIG. 9 is a perspective view illustrating the electromagnetic relay without the cover.

As illustrated in FIG. 9, the plurality of connection terminals 7 include the first connection terminal 71 and the second connection terminal 72. In a state in which the contact point 2 and the driver 3 are accommodated in the base 61, the plurality of connection terminals 7 protrude outside the base 61 through the grooves (through holes) 633 formed in the side surface section 614 of the base 61.

Figure 10:
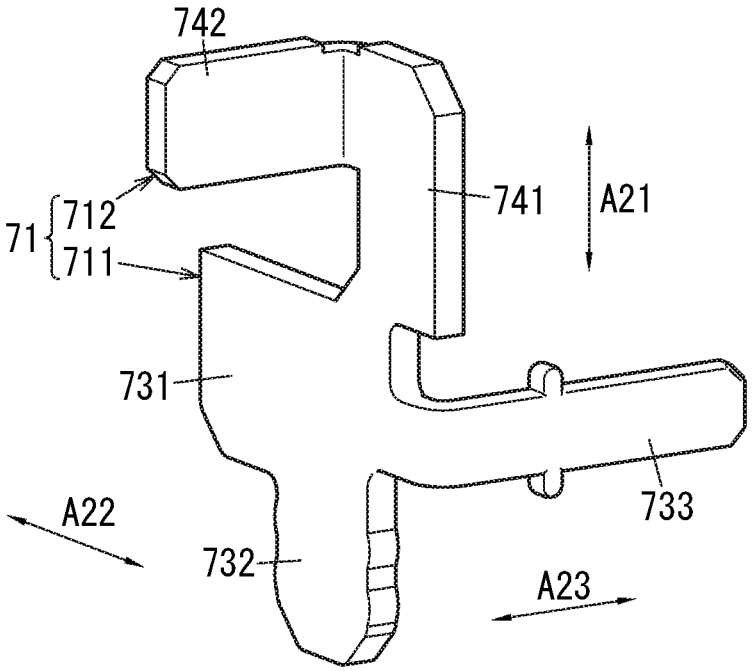
FIG. 10 is a perspective view illustrating a first terminal in the electromagnetic relay.

As illustrated in FIG. 10, the first connection terminal 71 includes a first terminal section 711 and a second terminal section 712. In the first connection terminal 71, the first terminal section 711 and the second terminal section 712 are integrally formed. The first connection terminal 71 is made of a metal material.

The first terminal section 711 is accommodated in the base 61 (see FIG. 4) and includes a first piece 731, a second piece 732, and a third piece 733. The first piece 731 and the second piece 732 are inserted into the first flange 351 of the bobbin 35, and a first end of the coil 36 is electrically connected to the third piece 733. The third piece 733 protrudes in a third direction A23 from a side end of the first piece 731 in a second direction A22. The first piece 731, the second piece 732, and the third piece 733 are integrally formed.

The second terminal section 712 protrudes outside the base 61 (see FIG. 5) through the groove 633 (see FIG. 5) and includes a first joint section 741 and a second joint section 742. The first joint section 741 is extended from the first terminal section 711 in a first direction A21. The second joint section 742 is extended from the first joint section 741 in a third direction A23 orthogonal to the first direction A21. Specifically, in the third direction A23, the second joint section 742 is extended in an orientation (leftward in FIG. 10) opposite to an orientation (rightward in FIG. 10) in which the third piece 733 is extended. The first joint section 741 and the second joint section 742 are integrally formed.

Figure 11:
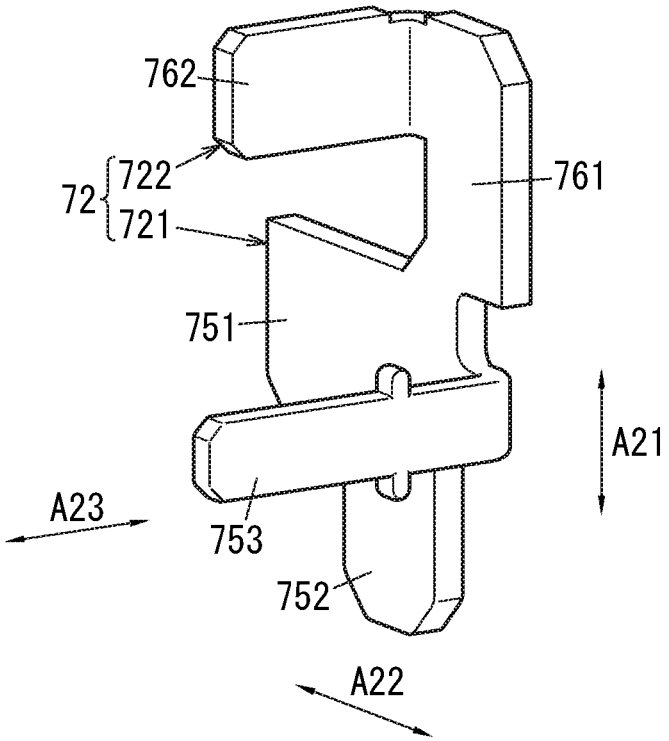
FIG. 11 is a perspective view illustrating a second terminal in the electromagnetic relay.

Similarly to the first connection terminal 71, the second connection terminal 72 includes a first terminal section 721 and a second terminal section 722 as illustrated in FIG. 11. In the second connection terminal 72, the first terminal section 721 and the second terminal section 722 are integrally formed. The second connection terminal 72 is made of a metal material.

Similarly to the first terminal section 711, the first terminal section 721 is accommodated in the base 61 (see FIG. 4) and includes a first piece 751, a second piece 752, and a third piece 753. The first piece 751 and the second piece 752 are inserted into the second flange 352 of the bobbin 35, and a remaining terminal (second terminal) of the coil 36 is electrically connected to the third piece 753. The third piece 753 protrudes in the third direction A23 from a side edge of the first piece 751 in the second direction A22. The first piece 751, the second piece 752, and the third piece 753 are integrally formed.

Similarly to the second terminal section 712, the second terminal section 722 protrudes outside the base 61 (see FIG. 5) through the groove 633 (see FIG. 5) and includes a first joint section 761 and a second joint section 762. The first joint section 761 is extended from the first terminal section 721 in the first direction A21. The second joint section 762 is extended from the first joint section 761 in the third direction A23 orthogonal to the first direction A21. Unlike the second joint section 742, the second joint section 762 is extended in the third direction A23 in the same orientation (leftward in FIG. 11) as the orientation in which the third piece 753 is extended. The first joint section 761 and the second joint section 762 are integrally formed.

Note that similarly to the second joint section 742, the second joint section 762 may be extended in the third direction A23 in an orientation opposite to the orientation in which the third piece 753 is extended. In this case, the first connection terminal 71 and the second connection terminal 72 are components having the same shapes.

Here, as illustrated in FIGS. 2 to 4, the electromagnetic relay 1 further includes an arc-extinguishing member 11. The arc-extinguishing member 11 is disposed in a space surrounded by the contact point 2 (the fixed contact 21 and the movable contact 22), the electromagnet section 31, the armature 32, and the card 34 in the base 61. The arc-extinguishing member 11 includes a permanent magnet 111 and a yoke 112. The permanent magnet 111 has a rectangular plate shape and is magnetized to have opposite polarities in the thickness direction. The yoke 112 has an L-shape. The permanent magnet 111 and the yoke 112 are accommodated in an accommodation section 636 provided to the base 61.

The accommodation section 636 has a box shape whose outer contour is in L-shape. The accommodation section 636 inwardly protrudes from the bottom surface section 611 of the base 61. Moreover, the accommodation section 636 is hollow. The permanent magnet 111 and the yoke 112 are inserted through an insertion opening 637 which is open on a rear side of the base 61, and the permanent magnet 111 and the yoke 112 are accommodated in the accommodation section 636.

Next, operation of the electromagnetic relay 1 according to the first embodiment will be described with reference to FIGS. 1 to 4.

In a state in which no voltage is applied between the plurality of connection terminals 7, the electromagnet section 31 does not drive the armature 32. Thus, the contact spring 23 is not pulled by the card 34, and therefore, the movable contact 22 and the fixed contact 21 face each other with a prescribed gap therebetween. Here, the first terminal 41 and the second terminal 42 are in a non-conductive state (off state).

On the other hand, in a state in which a voltage is applied between the plurality of connection terminals 7, the electromagnet section 31 drives the armature 32, and the armature 32 pivots anticlockwise in FIG. 8. Thus, the contact spring 23 is pulled by the card 34 and warps leftward in FIG. 4, so that the movable contact 22 comes into contact with the fixed contact 21. At this time, the first terminal 41 and the second terminal 42 are in a conductive state (on state). Note that, in the on state, when the voltage is no longer applied between the plurality of connection terminals 7, the armature 32 pivots clockwise in FIG. 8 and comes into the off state.

Here, when the first terminal 41 and the second terminal 42 change from the on state to the off state, arc discharge may occur between the movable contact 22 and the fixed contact 21. When the arc discharge occurs, the arc generated has to be promptly extinguished, and the arc discharge has to be terminated within a short period of time. Thus, in the electromagnetic relay 1 according to first embodiment, the arc-extinguishing member 11 including the permanent magnet 111 and the yoke 112 is accommodated in the accommodation section 636 of the base 61. That is, the permanent magnet 111 and the yoke 112 form a magnetic field around the fixed contact 21 and the movable contact 22 to extend the arc by using electromagnetic force due to the magnetic field, thereby extinguishing the arc.

Next, with reference to FIGS. 12 and 13, the relay device 8 according to the first embodiment will be described.

The relay device 8 includes the electromagnetic relay 1 described above and a pair of lead wires (external connection bodies) 91 and is connected to an external apparatus (not shown) of lead wire connection.

Figure 12:
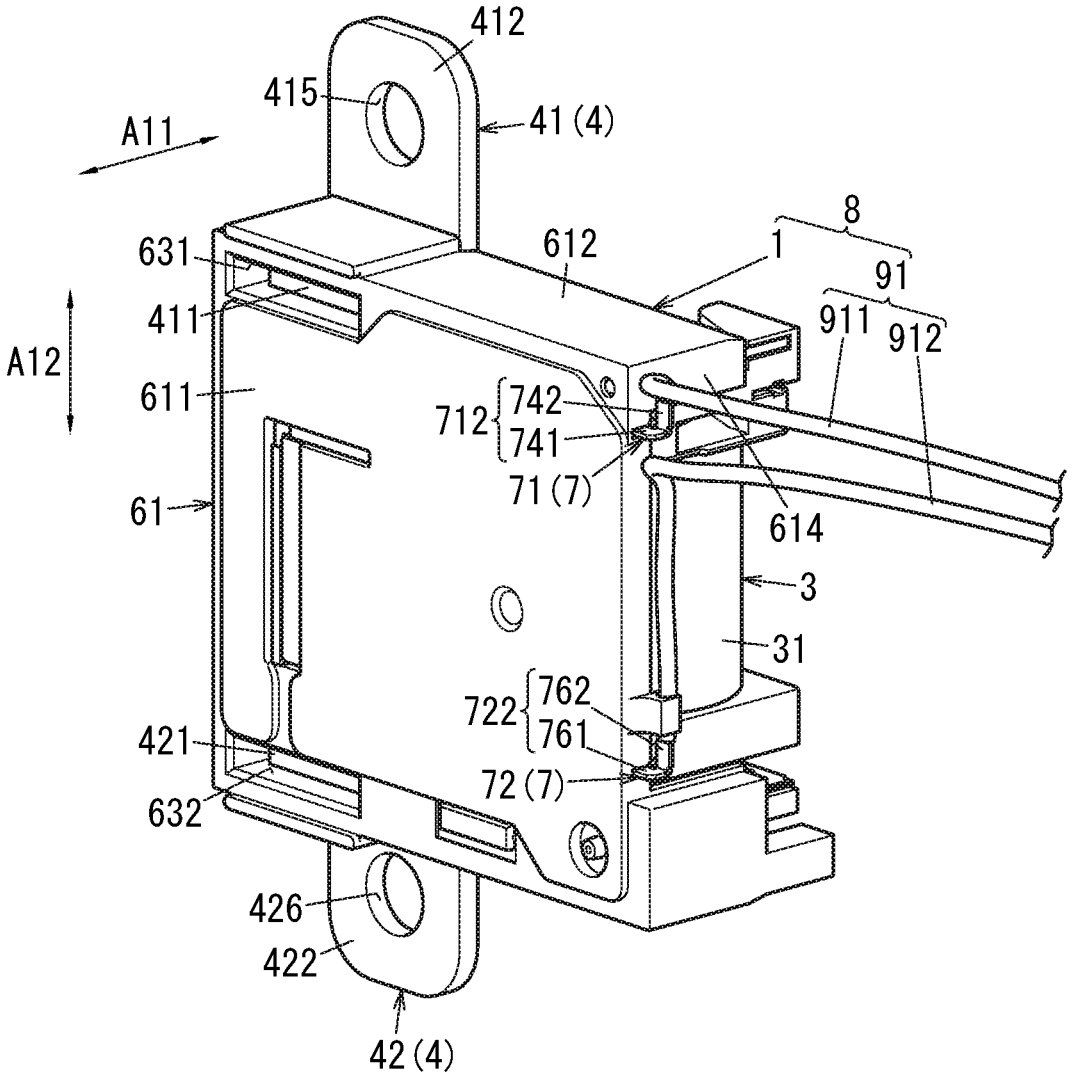
FIG. 12 is a perspective view illustrating a relay device of the first embodiment of the present disclosure without the cover.
Figure 13:
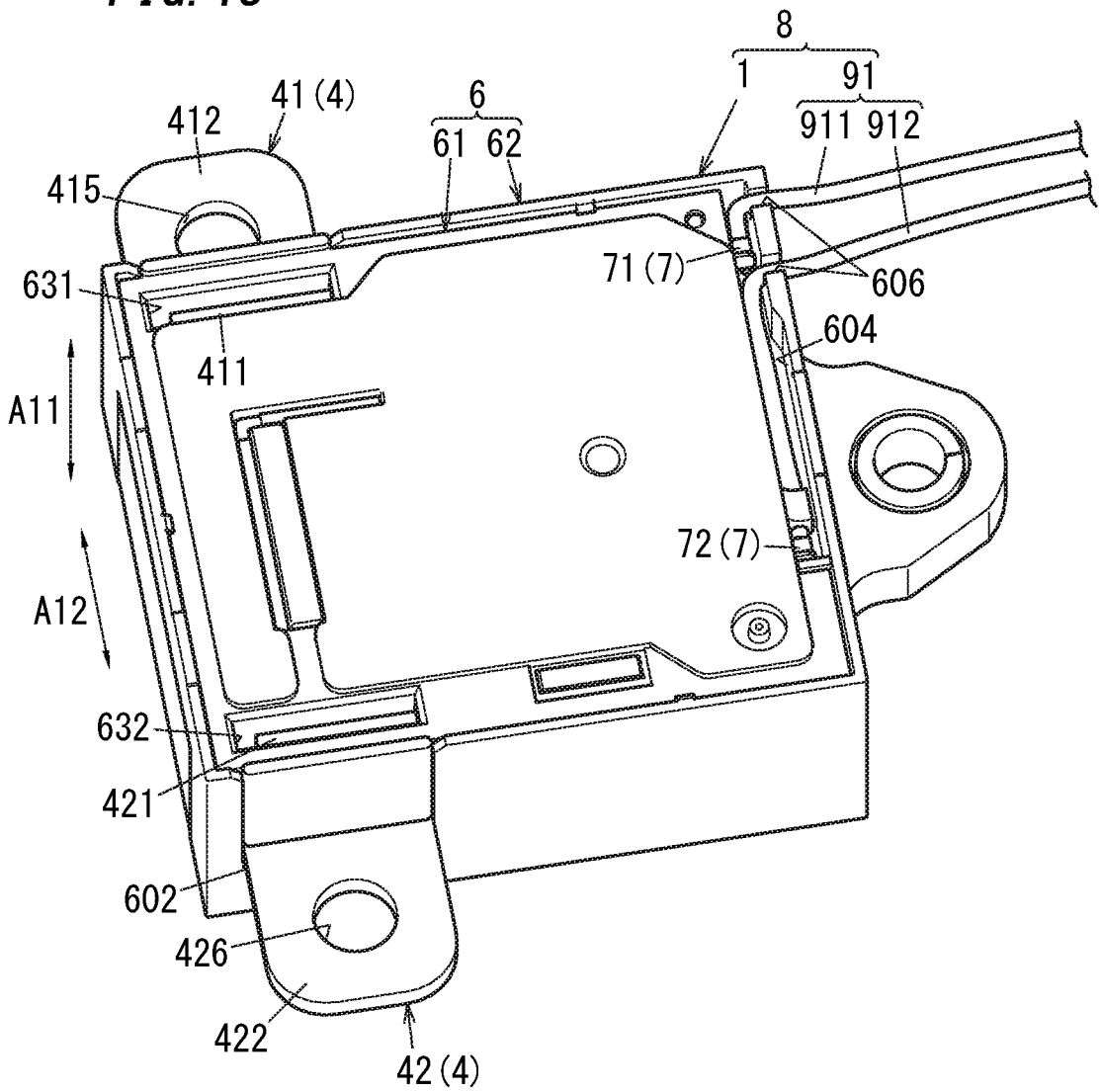
FIG. 13 is a perspective view illustrating the relay device.

As illustrated in FIGS. 12 and 13, the pair of lead wires 91 (a first lead wire 911 and a second lead wire 912) are respectively electrically connected to the second joint section 742 of the first connection terminal 71 and the second joint section 762 of the second connection terminal 72. In a state in which the lead wires 91 are fitted in grooves 606 formed in the cover 62, tips of the lead wires 91 are drawn out of the case 6.

According to the electromagnetic relay 1 of the first embodiment, simply applying the sealant onto the outer surface of the bottom surface section (first peripheral wall section) 611 of the base 61 enables the sealant to flow from the exterior surface of the bottom surface section 611 via flow paths to the through hole 601 of the side surface sections (second peripheral wall sections) 612 and 622 and to the through hole 602 of the side surface sections (second peripheral wall sections) 613 and 623. This enables closing of the gap 603 of the bottom surface section 611 with the sealant and adhesion of the terminal piece 412 of the first terminal 41 and the terminal piece 422 of the second terminal 42 to the case 6 by using the sealant flowing through the flow paths. As a result, the number of steps and time required for the steps can be reduced as compared to the case where closing of the gap of the case and adhesion of the terminal piece of the terminal are separately performed.

The electromagnetic relay 1 of the first embodiment enables the sealant applied to the outer surface of the bottom surface section (first peripheral wall section) 611 to easily flow along the first wall sections (wall sections) 641 and 642 and the second wall sections (wall sections) 651 and 652 provided in the case 6 by using surface tension and a capillary action. Thus, the sealant is easily allowed to flow toward the through holes 601 and 602.

According to the electromagnetic relay 1 of the first embodiment, the connection terminals 7 lying the space 604 surrounded by the base 61 and the cover 62 are provided, and the space 604 in which the second terminal sections 712 and 722 of the connection terminals 7 lie is sealed. Thus, it is possible to achieve compatibility with various external connection bodies and a stable joint of the external connection bodies.

According to the electromagnetic relay 1 of the first embodiment, the first joint sections 741 and 761 of the connection terminals 7 are disposed along a direction different from the direction of the second joint sections 742 and 762 of the connection terminals 7, and therefore, the external connection bodies can be connected to the connection terminals 7 in various directions.

According to the electromagnetic relay 1 of the first embodiment, when the space 604 in which the second terminal sections 712 and 722 of the connection terminals 7 lie is sealed, a sealant can be put in the space 604 via the opening surface 635 of the cover 62.

Note that the lead wires 91 in the pair may be electrically connected to the respective first joint sections 741 and 761 of the first connection terminal 71 and the second connection terminal 72.

Second Embodiment

Figure 14:
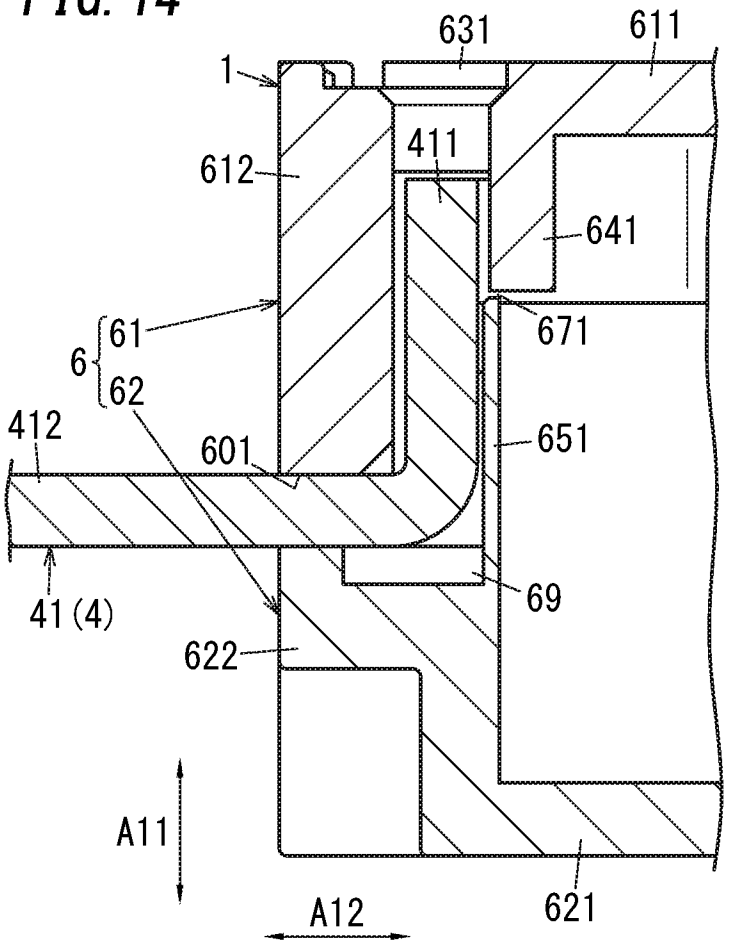
FIG. 14 is a sectional view illustrating a main part of an electromagnetic relay according to a second embodiment of the present disclosure.

As illustrated in FIG. 14, an electromagnetic relay 1 according to a second embodiment is different from the electromagnetic relay 1 (see FIG. 7) according to the first embodiment in that a case 6 has a storage space 69. Note that components similar to those of the electromagnetic relay 1 according to the first embodiment are denoted by the same reference signs, and the description thereof will be omitted.

The case 6 of the second embodiment has the storage space 69 for storing a sealant. The storage space 69 is adjacent to a first terminal 41 and a second terminal 42 (see FIG. 1) in the case 6. More specifically, a cover 62 of the second embodiment has the storage space 69 between a second wall section 651 and a side surface section 622. Similarly, the cover 62 has a storage space (not shown) between a second wall section 652 and a side surface section 623.

According to the electromagnetic relay 1 of the second embodiment described above, the sealant can be stored in the storage space 69, which can enlarge an adhesion area for adhesion of terminal pieces 412 and 422 of the first terminal 41 and the second terminal 42 to the case 6. This can increase an adhesive strength for the adhesion of the terminal pieces 412 and 422 of the first terminal 41 and the second terminal 42 to the case 6. That is, in the electromagnetic relay 1 of the second embodiment, the sealant flowing through holes 631 and 632 (see FIG. 1) of a base 61 into the case 6 can be stored in the storage space 69, and therefore, the first terminal 41 and the second terminal 42 can be more firmly fixed to the case 6.

Moreover, according to the electromagnetic relay 1 of the second embodiment, the adhesion area for adhesion of the terminal pieces 412 and 422 of the first terminal 41 and the second terminal 42 to the case 6 can be enlarged without increasing the entire size of the relay.

Figure 15:
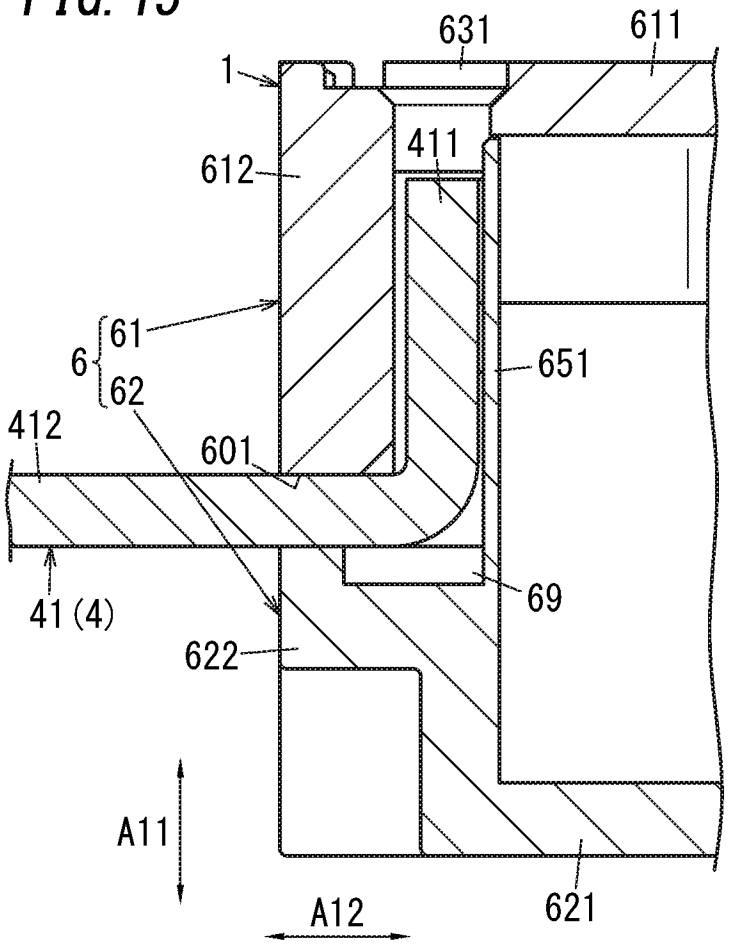
FIG. 15 is a sectional view illustrating a main part of an electromagnetic relay according to a first variation of the second embodiment of the present disclosure.

As illustrated in FIG. 15, in a first variation of the second embodiment, only the cover 62 may include the second wall section 651 and a second wall section 652 which are paired. That is, the base 61 of the first variation does not have to include a pair of first wall sections 641 and 642 (see FIG. 1). Each of the second wall sections 651 and 652 faces an inner surface of a bottom surface section 611 of the base 61.

Figure 16:
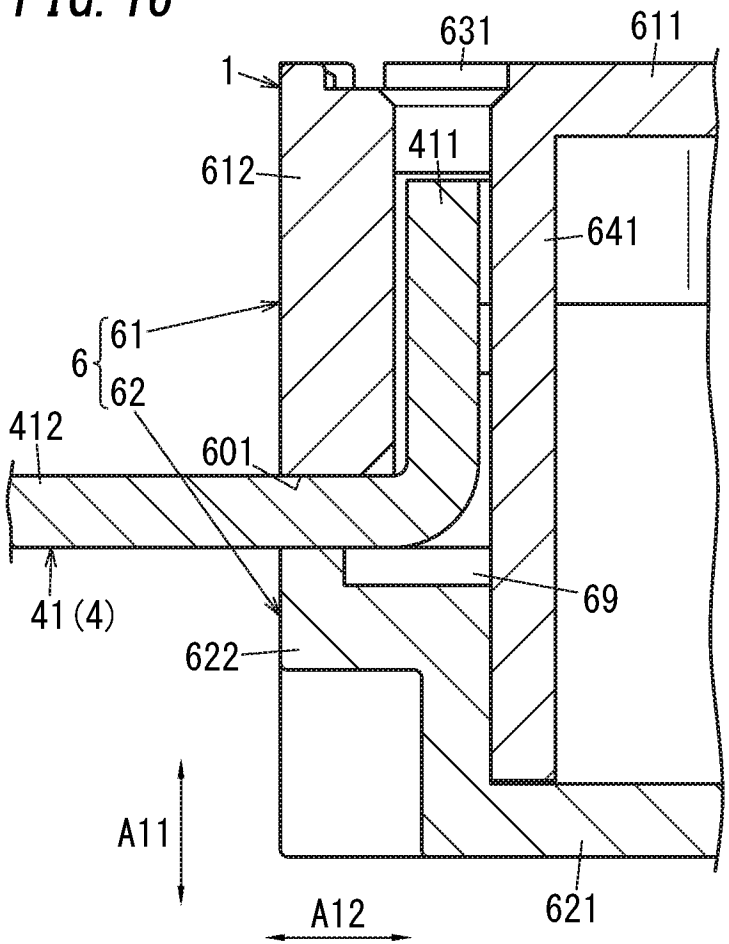
FIG. 16 is a sectional view illustrating a main part of an electromagnetic relay according to a second variation of the second embodiment of the present disclosure.

As illustrated in FIG. 16, in a second variation of the second embodiment, only the base 61 may include the pair of first wall sections 641 and 642. That is, the cover 62 of the second variation does not have to include the pair of second wall sections 651 and 652 (see FIG. 1). Each of the first wall sections 641 and 642 faces an inner surface of a bottom surface section 621 of the cover 62.

Figure 17:
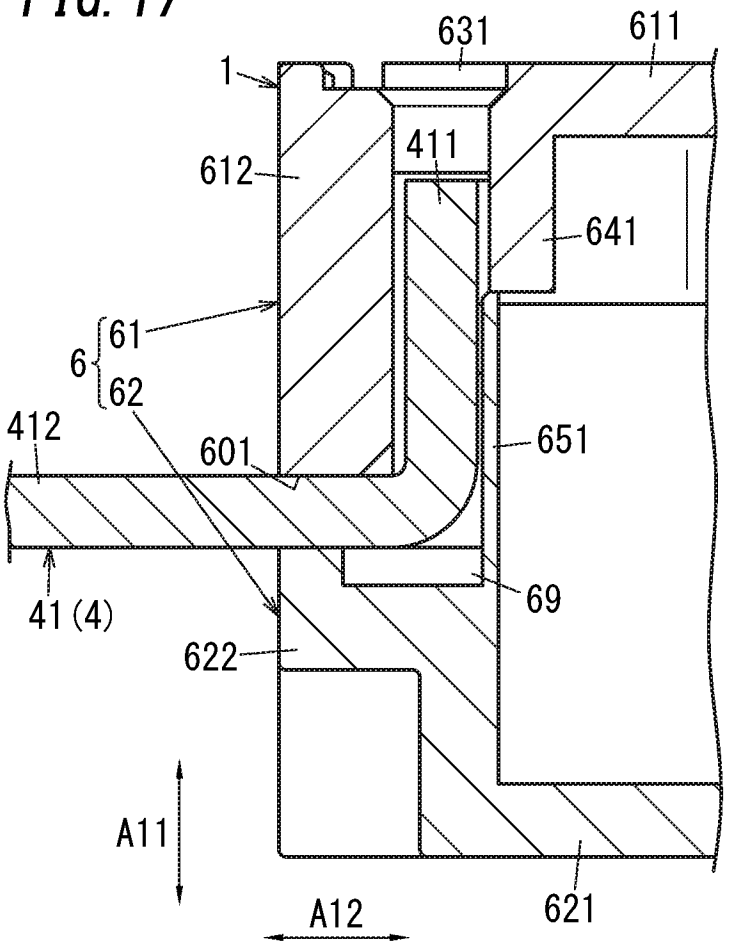
FIG. 17 is a sectional view illustrating a main part of an electromagnetic relay according to a third variation of the second embodiment of the present disclosure.

As illustrated in FIG. 17, in a third variation of the second embodiment, in a direction (in FIG. 17, upward and downward direction) in which the first wall section 641 of the base 61 and the second wall section 651 of the cover 62 protrude, a tip of the first wall section 641 of the base 61 and a tip of the second wall section 651 of the cover 62 may be in contact with each other. Similarly, in a direction in which the first wall section 642 of the base 61 and the second wall section 652 of the cover 62 protrude, a tip of the first wall section 642 of the base 61 and a tip of the second wall section 652 of the cover 62 may be in contact with each other.

In the electromagnetic relay 1 according to the third variation, the tip of the first wall section 641 and the tip of the second wall section 651 are in contact with each other, and therefore, the sealant smoothly flows from the hole 631 through the first wall section 641 and the second wall section 651. Similarly, the tip of the first wall section 642 and the tip of the second wall section 652 are in contact with each other, and therefore, the sealant smoothly flows from the hole 632 through the first wall section 642 and the second wall section 652. As a result, the first terminal 41 and the second terminal 42 can be easily covered with the sealant.

Figure 18:
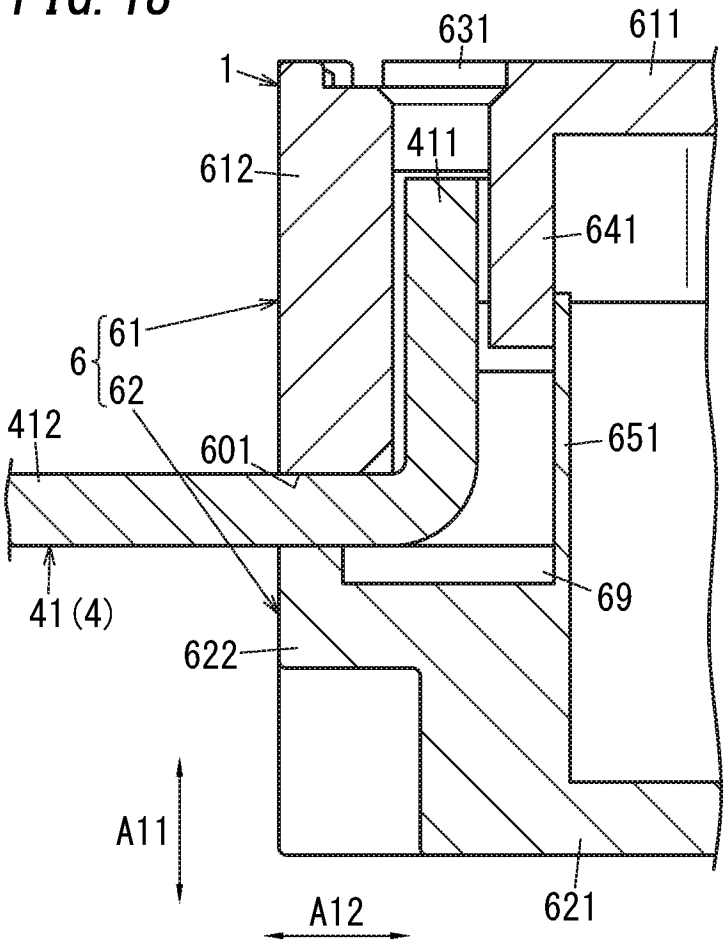
FIG. 18 is a sectional view illustrating a main part of an electromagnetic relay according to a fourth variation of the second embodiment of the present disclosure.

As illustrated in FIG. 18, in a fourth variation of the second embodiment, the tip of the first wall section 641 of the base 61 and the tip of the second wall section 651 of the cover 62 may overlap each other in the right and left direction in FIG. 18. Similarly, the tip of the first wall section 642 of the base 61 and the tip of the second wall section 652 of the cover 62 may overlap each other in the right and left direction. In the example shown in FIG. 18, the first wall section 641 is situated outwardly (in the left direction in FIG. 18) farther than the second wall section 651 in the right and left direction. Thus, the sealant flowing along the first wall section 641 does not accumulate at the border between the first wall section 641 and the second wall section 651 but smoothly flows from the first wall section 641 to the second wall section 651. Similarly, the first wall section 642 is situated outwardly farther than the second wall section 652 in the right and left direction. Thus, the sealant flowing along the first wall section 642 does not accumulate at the border between the first wall section 642 and the second wall section 652 but smoothly flows from the first wall section 642 to the second wall section 652.

Figure 19:
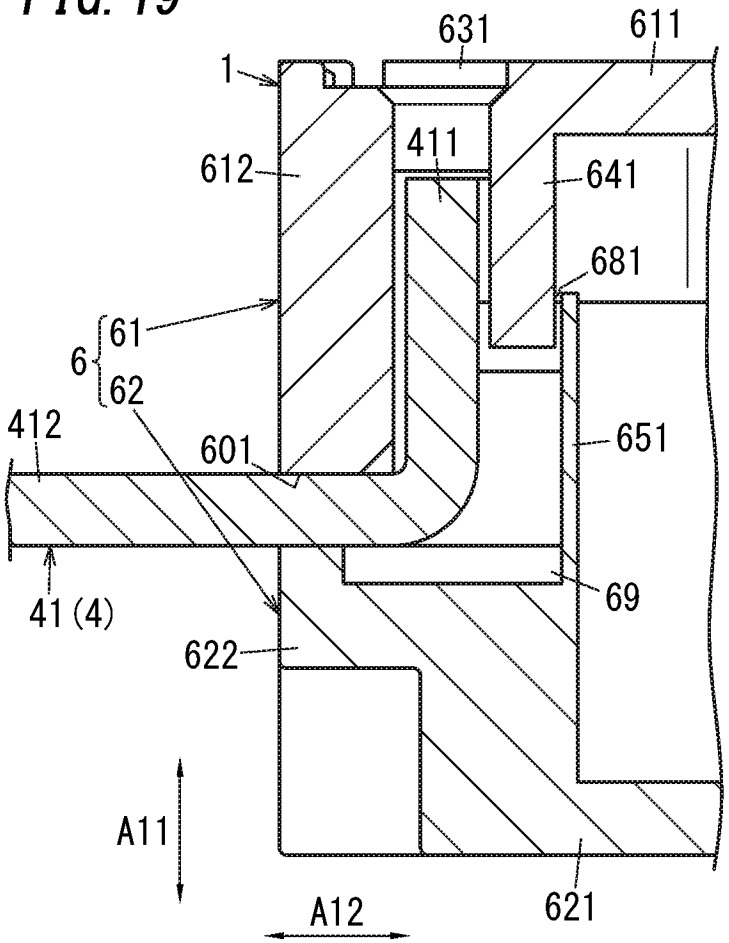
FIG. 19 is a sectional view illustrating a main part of an electromagnetic relay according to a fifth variation of the second embodiment of the present disclosure.

As illustrated in FIG. 19, in a fifth variation of the second embodiment, the tip of the first wall section 641 of the base 61 and the tip of the second wall section 651 of the cover 62 may face each other in the right and left direction in FIG. 19 with a gap 681 provided therebetween. Similarly, the tip of the first wall section 642 of the base 61 and the tip of the second wall section 652 of the cover 62 may face each other in the right and left direction with a gap provided therebetween. In the example shown in FIG. 19, the first wall section 641 is situated outwardly (in the left direction in FIG. 19) farther than the second wall section 651 in the right and left direction. Thus, the sealant flowing along the first wall section 641 does not accumulate at the border between the first wall section 641 and the second wall section 651 but smoothly flows from the first wall section 641 to the second wall section 651. Similarly, the first wall section 642 is situated outwardly farther than the second wall section 652 in the right and left direction. Thus, the sealant flowing along the first wall section 642 does not accumulate at the border between the first wall section 642 and the second wall section 652 but smoothly flows from the first wall section 642 to the second wall section 652.

Figure 20:
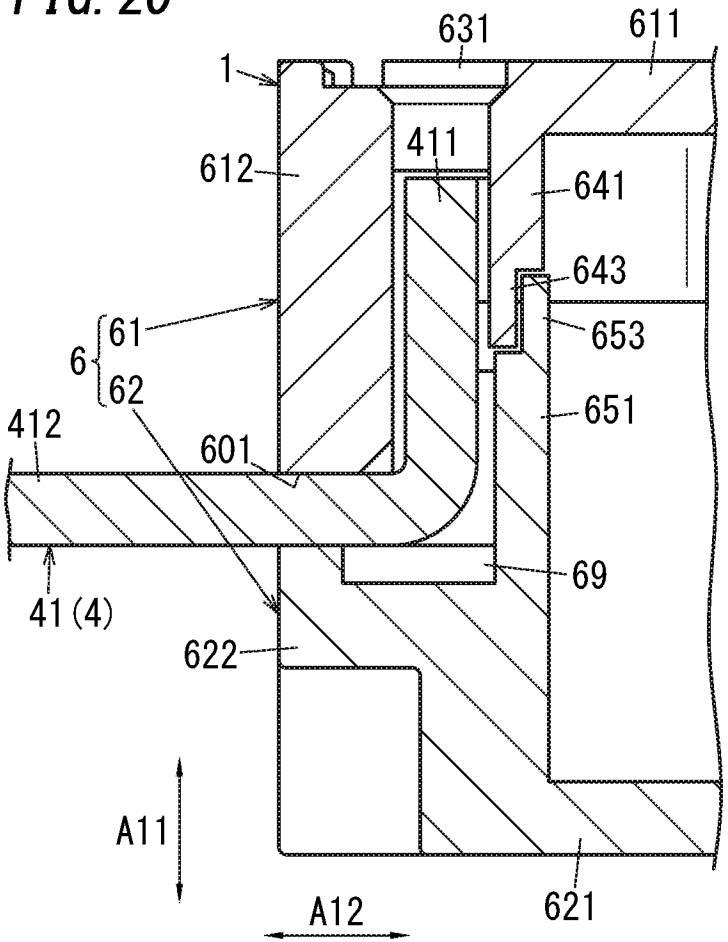
FIG. 20 is a sectional view illustrating a main part of an electromagnetic relay according to a sixth variation of the second embodiment of the present disclosure.

As illustrated in FIG. 20, in a sixth variation of the second embodiment, the tip of the first wall section 641 of the base 61 and the tip of the second wall section 651 of the cover 62 may engage with each other. In the example shown in FIG. 20, the first wall section 641 of the base 61 includes an engagement section 643 which downwardly protrudes. The second wall section 651 of the cover 62 includes an engagement section 653 which upwardly protrudes. When the first wall section 641 of the base 61 and the second wall section 651 of the cover 62 engage with each other, the engagement section 643 of the base 61 is situated outwardly (the left direction in FIG. 20) farther than the engagement section 653 of the cover 62 in the right and left direction. Moreover, the first wall section 641 of the base 61 is situated outwardly slightly farther than the second wall section 651 of the cover 62 in the right and left direction. Similarly, the first wall section 642 of the base 61 includes an engagement section (not shown) which downwardly protrudes. The second wall section 652 of the cover 62 includes an engagement section (not shown) which upwardly protrudes. When the first wall section 642 of the base 61 and the second wall section 652 of the cover 62 engage with each other, the engagement section of the base 61 is situated outwardly farther than the engagement section of the cover 62 in the right and left direction. Moreover, the first wall section 642 of the base 61 is situated outwardly slightly farther than the second wall section 652 of the cover 62 in the right and left direction.

In the electromagnetic relay 1 according to the sixth variation, the first wall section 641 is situated outwardly farther than the second wall section 651 in the right and left direction. Thus, the sealant flowing along the first wall section 641 does not accumulate at the border between the first wall section 641 and the second wall section 651 but smoothly flows from the first wall section 641 to the second wall section 651. Similarly, the first wall section 642 is situated outwardly farther than the second wall section 652 in the right and left direction. Thus, the sealant flowing along the first wall section 642 does not accumulate at the border between the first wall section 642 and the second wall section 652 but smoothly flows from the first wall section 642 to the second wall section 652.

Third Embodiment

Figure 21:
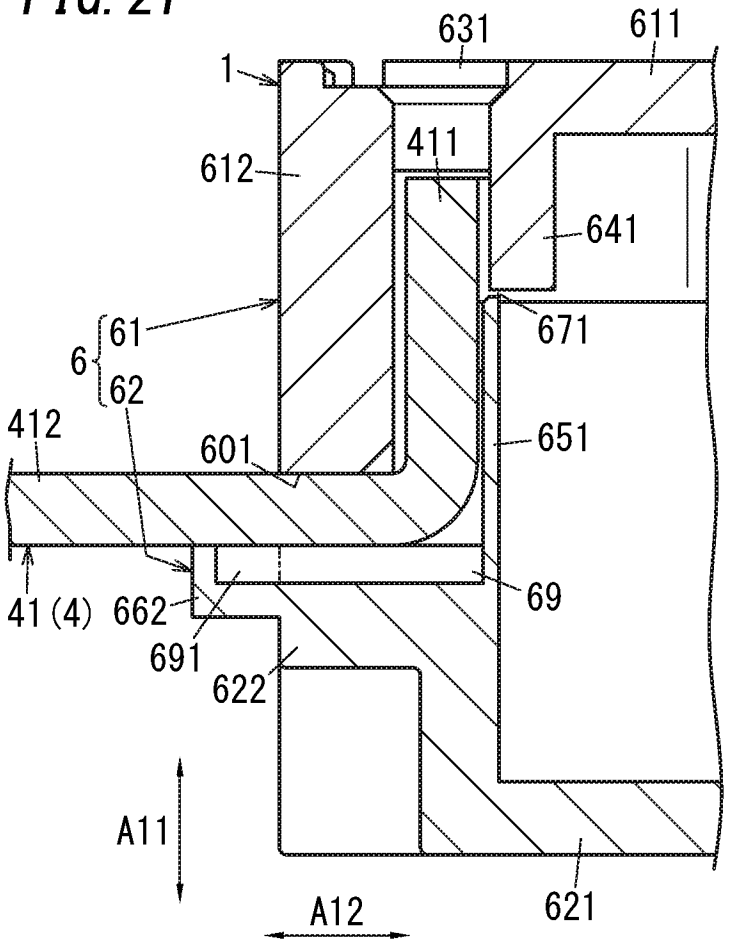
FIG. 21 is a sectional view illustrating a main part of an electromagnetic relay according to a third embodiment of the present disclosure.

An electromagnetic relay 1 according to a third embodiment is different from the electromagnetic relay 1 (see FIG. 14) according to the second embodiment in that a storage space 69 as shown in FIG. 21 is provided. Note that components similar to those of the electromagnetic relay 1 according to the second embodiment are denoted by the same reference signs, and the description thereof will be omitted.

A cover 62 of a case 6 of the third embodiment includes a projection 662 which protrudes from a side surface section 622 forming a second peripheral wall section. Similarly, the cover 62 includes a projection (not shown) which protrudes from a side surface section 623 (see FIG. 1) forming the second peripheral wall section. Note that the description of functions of those of the cover 62 of the second embodiment will be omitted.

The storage space 69 of the third embodiment is in communication with a through hole 601 and has a space 691 surrounded by the projection 662.

According to the electromagnetic relay 1 of the third embodiment described above, even when the storage space 69 cannot be sufficiently secured in the case 6, the storage space 69 can be secured inclusively of the space 691 surrounded by the projection 662, and therefore, the degree of freedom in designing the storage space 69 can be increased.

Note that as a variation of the third embodiment, a flow path through which a sealant flows may be provided outside the case 6. More specifically, the flow path of the present variation may be formed on the outer surface of a side surface section (second peripheral wall section) 612 outside the case 6 and may be in communication with the through hole 601, and the flow path of the present variation may be formed on the outer surface of a side surface section (second peripheral wall section) 613 outside the case 6 and may be in communication with the through hole 602.

Figure 22:
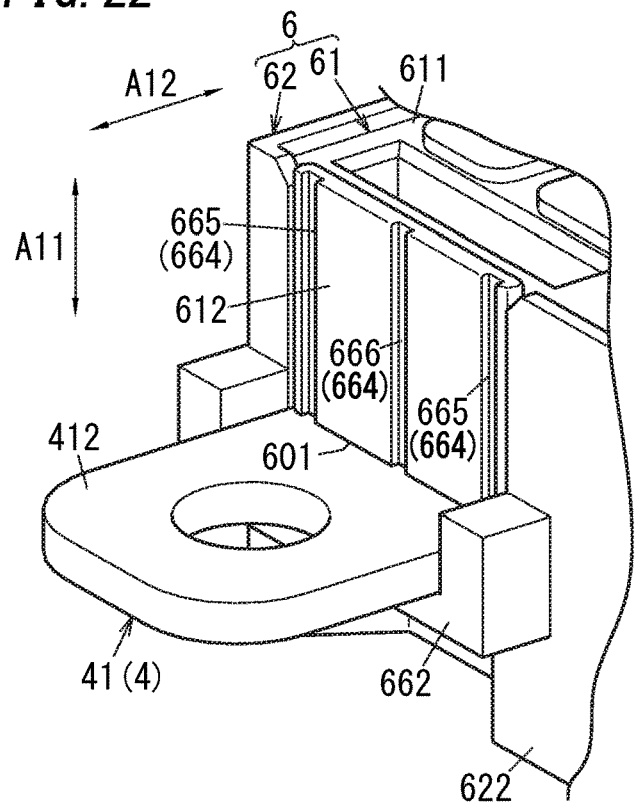
FIG. 22 is a perspective view illustrating a main part of an electromagnetic relay according to a variation of the third embodiment of the present disclosure.

As illustrated in FIG. 22, the side surface section 612 of the base 61 of the present variation has a plurality of (in FIG. 22, three) grooves 664 serving as flow paths of the sealant. Similarly, a side surface section 613 (see FIG. 1) of the base 61 of the third embodiment also has a plurality of grooves (not shown) serving as flow paths of the sealant.

The plurality of grooves 664 are parallel to each other. Similarly, the plurality of grooves of the side surface section 613 are also parallel to each other. Moreover, the plurality of grooves 664 include a pair of first grooves 665 in communication with both ends of the through hole 601 and a second groove 666 formed between the first grooves 665 in the pair. Similarly, the plurality of grooves of the side surface section 613 also include a pair of first grooves in communication with both sides of the through hole 602 and a second groove formed between the first grooves in the pair.

According to the electromagnetic relay 1 of the present variation, the sealant is allowed to flow through the flow paths formed in the outer surfaces of the side surface sections (second peripheral wall sections) 612 and 613 of the base 61 from an outer surface of a bottom surface section (first peripheral wall section) 611 of the base 61 to the through hole 601 of the side surface sections (second peripheral wall sections) 612 and 622 and to the through hole 602 of the side surface sections (second peripheral wall sections) 613 and 623. Therefore, it is possible to externally check the flow of the sealant.

The number of the grooves 664 formed in the side surface section 612 is not limited to three, but one groove may be formed, or two grooves may be formed. Alternatively, the number of grooves 664 may be four or more. Similarly, the number of grooves formed in the side surface section 613 is not limited to three, but one groove may be formed, or two grooves may be formed. Alternatively, the number of grooves formed in the side surface section 613 may be four or more.

The locations of the grooves 664 formed in the side surface section 612 are not limited to the locations of the example shown in FIG. 22. The grooves 664 may be formed in any locations in the side surface section 612. Similarly, the grooves formed in the side surface section 613 may be formed in any locations in the side surface section 613.

Fourth Embodiment

Figure 23:
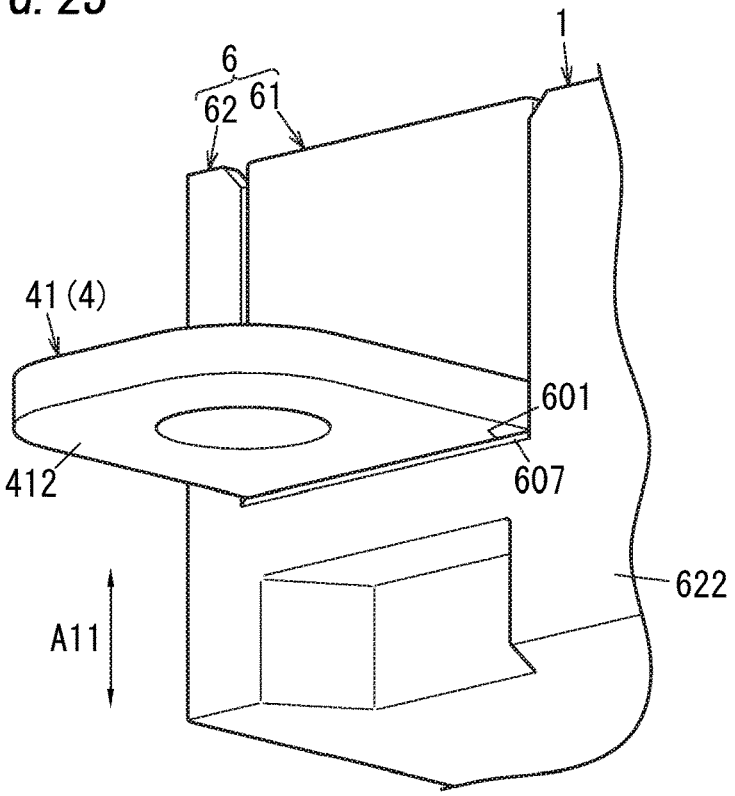
FIG. 23 is a perspective view illustrating a main part of an electromagnetic relay according to a fourth embodiment of the present disclosure.
Figure 24:
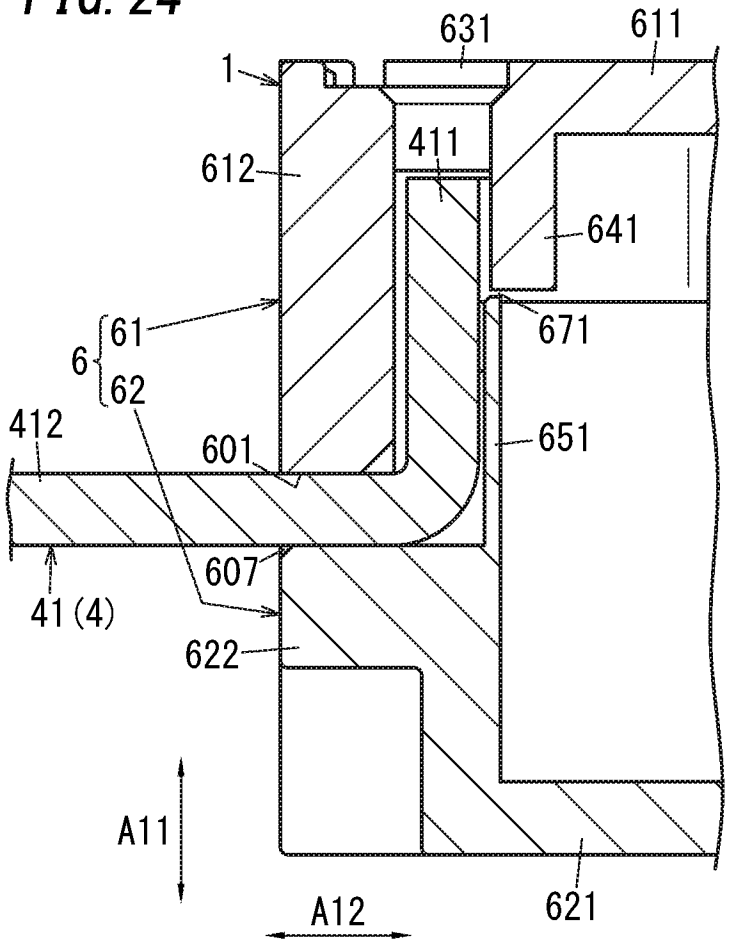
FIG. 24 is a sectional view illustrating the main part of the electromagnetic relay.

An electromagnetic relay 1 according to a fourth embodiment is different from the electromagnetic relay 1 (see FIG. 7) according to the first embodiment in that a case 6 has a window 607 as illustrated in FIGS. 23 and 24. Note that components similar to those of the electromagnetic relay 1 according to the first embodiment are denoted by the same reference signs, and the description thereof will be omitted.

A cover 62 of the case 6 of the fourth embodiment has the window 607 adjacent to a through hole 601 in a side surface section (second peripheral wall section) 622. Similarly, the cover 62 of the fourth embodiment has a window (not shown) adjacent to a through hole 602 in a side surface section (second peripheral wall section) 623. More specifically, the window 607 is in communication with the through hole 601 and downwardly inclines from an inner side to an outer side in the side surface section 622. Note that the description of functions similar to those of the cover 62 of the first embodiment will be omitted.

According to the electromagnetic relay 1 of the fourth embodiment described above, when the sealant flowing along the flow paths reaches the through holes 601 and 602, the sealant emerges into the windows 607. Thus, whether or not the sealant reaches the through holes 601 and 602 can be checked through the windows 607. Note that the sealant does not leak from the windows 607 due to the viscosity and the surface tension of the sealant.

Figure 25:
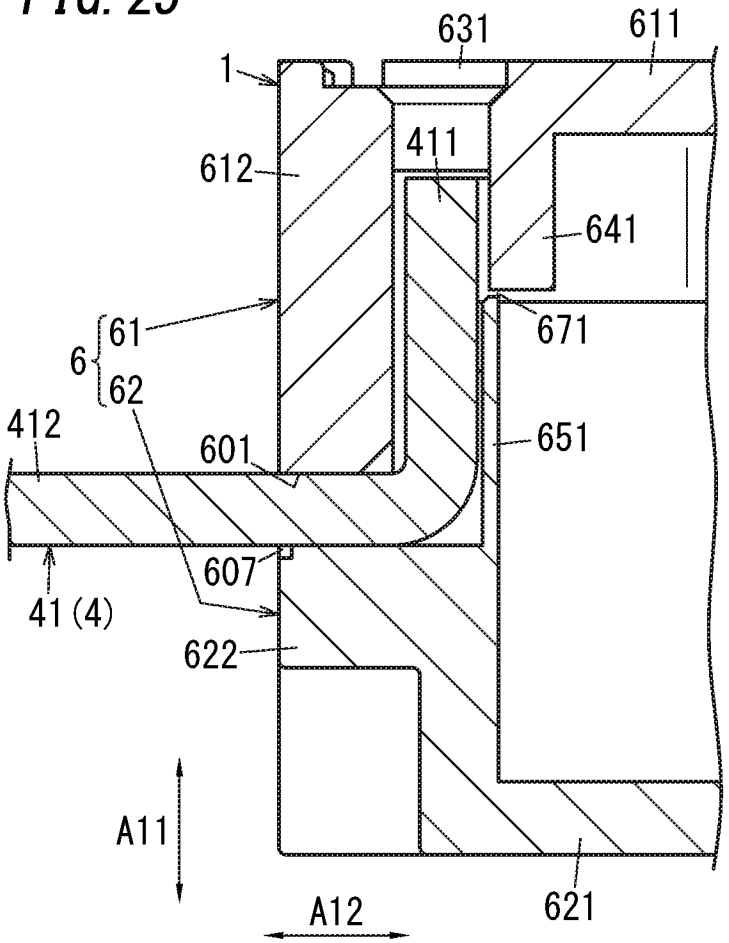
FIG. 25 is a sectional view illustrating a main part of an electromagnetic relay according to a variation of the fourth embodiment of the present disclosure.

As a variation of the fourth embodiment, the window 607 may have a rectangular shape as illustrated in FIG. 25. Also in the electromagnetic relay 1 according to the present variation, whether or not the sealant reaches the through holes 601 and 602 can be checked through the window 607.

Fifth Embodiment

In the fifth embodiment, a relay device 8 corresponding to an external apparatus of connector connection will be described.

Figure 26:
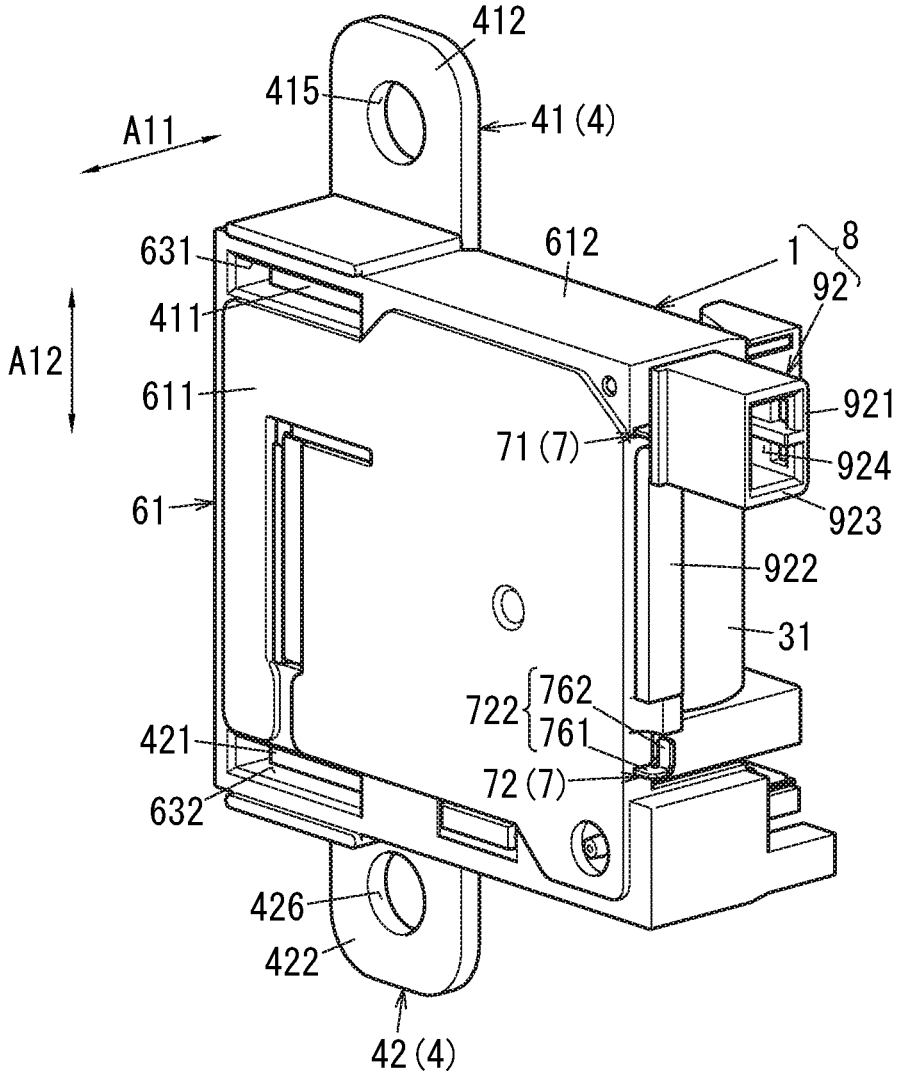
FIG. 26 is a perspective view illustrating a relay device according to a fifth embodiment of the present disclosure without a cover.
Figure 27:
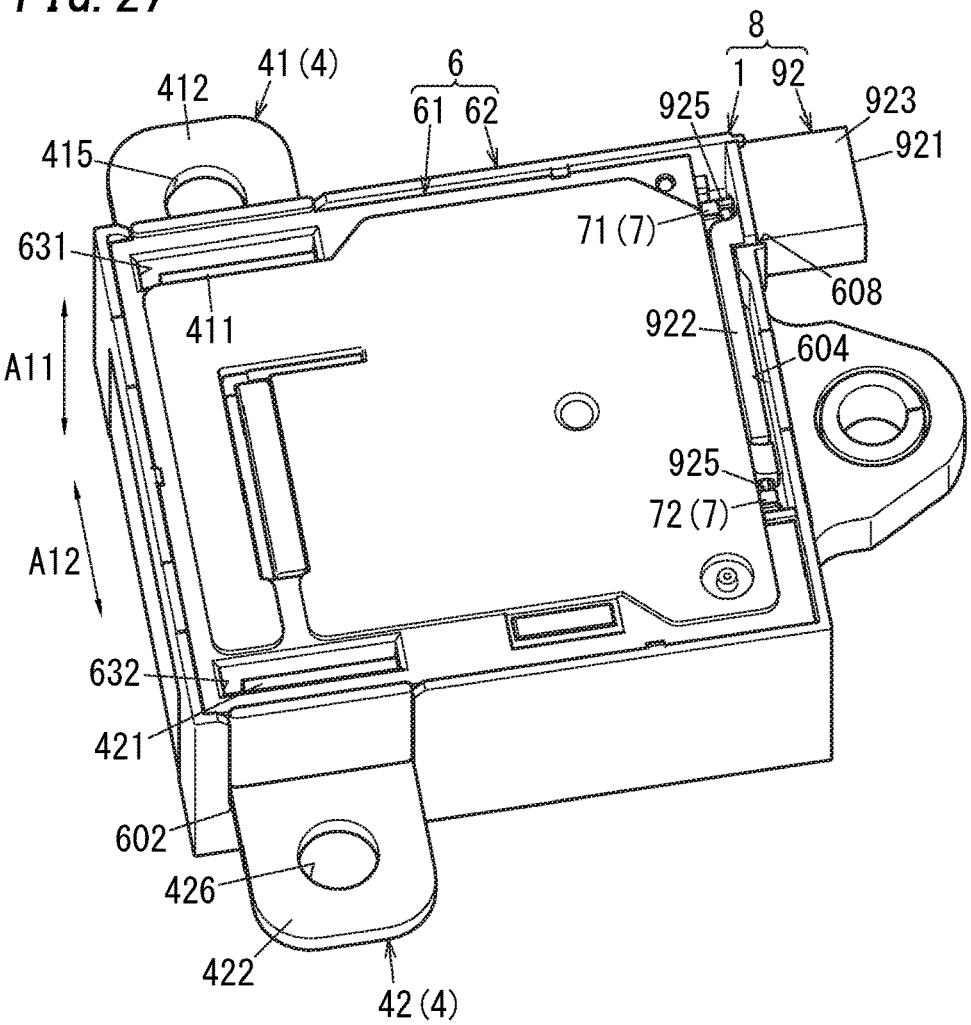
FIG. 27 is a perspective view illustrating the relay device.

As illustrated in FIGS. 26 and 27, the relay device 8 according to the fifth embodiment includes a connector 92 as illustrated in FIGS. 26 and 27 as an external connection body, instead of the pair of lead wires 91 (see FIG. 13) of the first embodiment. Note that components similar to those of the relay device 8 (see FIGS. 12 and 13) according to the first embodiment are denoted by the same reference signs, and the description thereof will be omitted.

Figure 28:
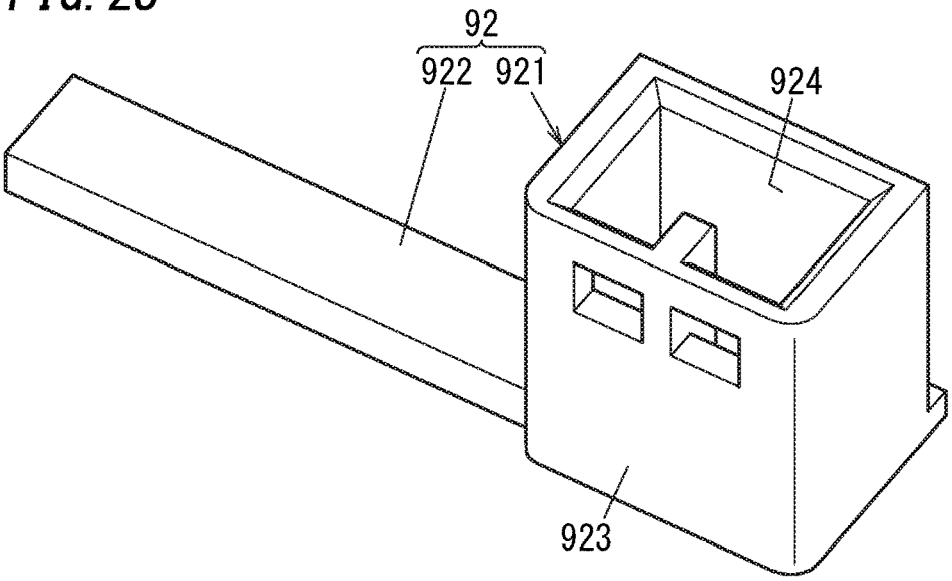
FIG. 28 is a perspective view illustrating a connector of the relay device.

As illustrated in FIG. 28, the connector 92 includes a connector section 921 and an insertion section 922. The insertion section 922 is integrally formed with the connector section 921. The connector section 921 includes a pair of terminal sections (not shown) and a connector body 923 having a box shape and having an opening in its one surface. The pair of terminal sections is accommodated in a space 924 of the connector body 923. The connector section 921 is configured to be joined to a connector of an external apparatus with the connector of the external apparatus being accommodated in the space 924 of the connector body 923.

As illustrated in FIG. 27, the connector 92 is attached to a case 6 such that the insertion section 922 is accommodated in a space 604 of the case 6 and the connector section 921 lies outside a cover 62 through an opening section 608 of the cover 62. In a state in which the connector 92 is attached to the case 6, the pair of terminal sections (not shown) of the connector 92 is electrically connected through a pair of conductors 925 to a pair of connection terminals 7.

In the relay device 8 according to the fifth embodiment described above, the connectors 92 as an external connection body are electrically connected to the connection terminals 7, and therefore, the relay device 8 can be easily compatible with external apparatuses of connector connection.

Sixth Embodiment

In a sixth embodiment, a relay device 8 compatible with external apparatuses of plug-in connection will be described.

Figure 29:
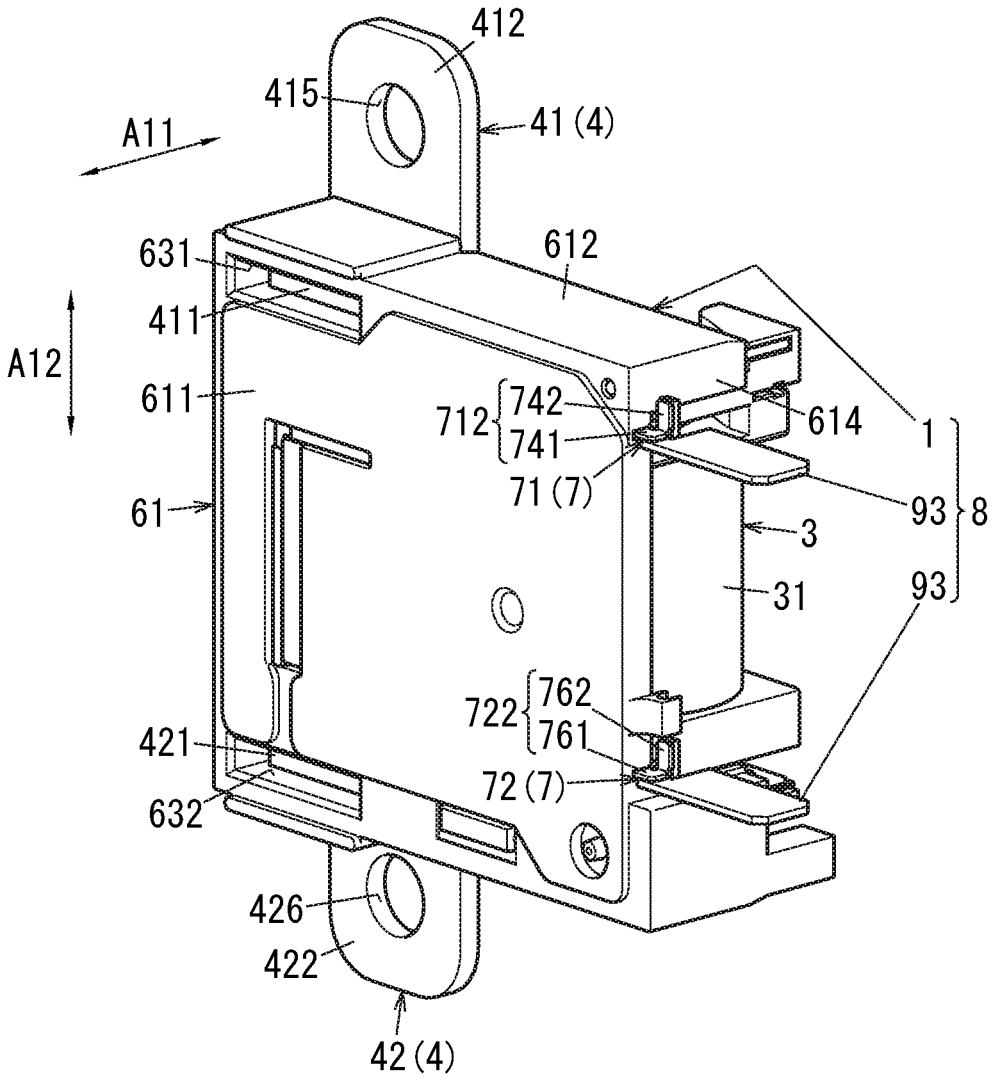
FIG. 29 is a perspective view illustrating a relay device according to a sixth embodiment of the present disclosure without a cover.
Figure 30:
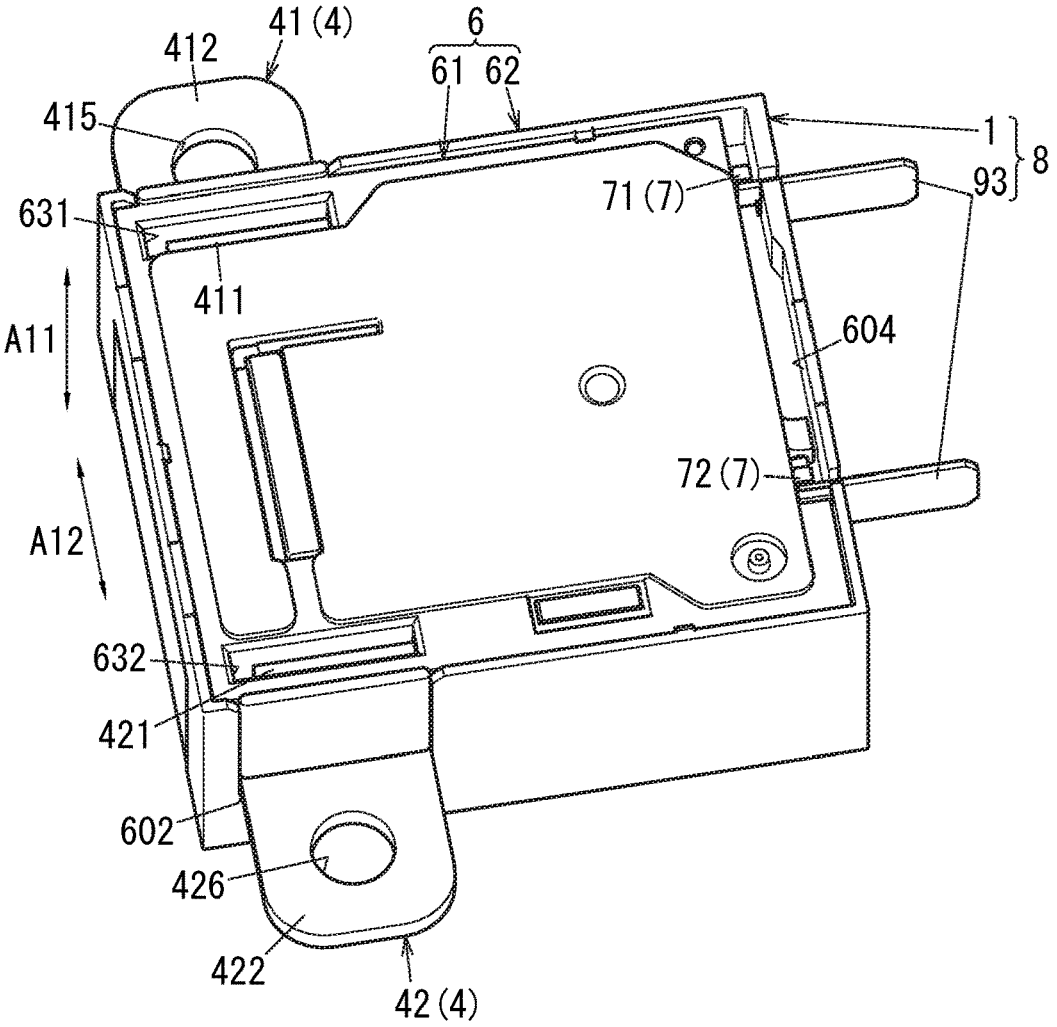
FIG. 30 is a perspective view illustrating the relay device.

As illustrated in FIGS. 29 and 30, the relay device 8 according to the sixth embodiment includes a pair of plug terminals 93 as illustrated in FIGS. 29 and 30 as external connection bodies instead of the pair of lead wires 91 (see FIG. 13) of the first embodiment. Note that, components similar to the relay device 8 (see FIGS. 12 and 13) according to the first embodiment are denoted by the same reference signs, and the description thereof will be omitted.

Figure 31:
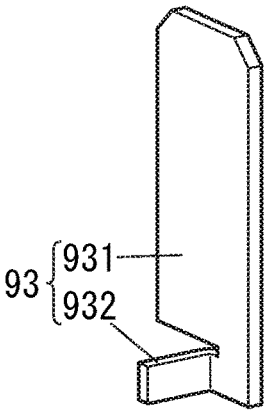
FIG. 31 is a perspective view illustrating a plug terminal of the relay device.

As illustrated in FIG. 31, each plug terminal 93 includes a base piece 931 and a connection piece 932. The base piece 931 has a flat plate shape. The connection piece 932 is extended in a normal direction to the base piece 931 from one end (lower end) of the base piece 931 in the longitudinal direction. The connection piece 932 is integrally formed with the base piece 931. The connection piece 932 is joined to a connection terminal 7, for example, by welding. In the example shown in FIGS. 29 and 30, the connection pieces 932 are joined to second joint sections 742 and 762 of the connection terminals 7.

In the relay device 8 according to the sixth embodiment described above, the paired plug terminals 93 as external connection bodies are electrically connected to the respective connection terminals 7, and therefore, the relay device 8 can be easily compatible with external apparatuses of plug-in connection.

Note that the pair of plug terminals 93 may be joined to the respective first joint sections 741 and 761 of the connection terminals 7.

The electromagnetic relay according to the present disclosure is not limited to the first to sixth embodiments and variations thereof, but the electromagnetic relay may adopt various configurations within a scope of the technical idea of the present disclosure.

Note that the present disclosure is not limited to the electromagnetic relay. The present disclosure may be an electrical device other than the electromagnetic relay.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. An electromagnetic relay, comprising:

a contact point including a fixed contact and a movable contact;

a driver is configured to bring the movable contact into contact with the fixed contact and to separate the movable contact from the fixed contact;

a terminal electrically connected to the fixed contact or the movable contact; and a case accommodating the contact point and the driver, wherein the terminal includes a terminal piece having at least a portion located outside the case, the case includes a first peripheral wall section having a gap to be closed with a sealant and an outer surface to which the sealant is to be applied, and a second peripheral wall section which is a peripheral wall section different from the first peripheral wall section and which has a through hole through which the terminal piece is inserted, and the case has a flow path along which the sealant applied to the outer surface of the first peripheral wall section flows from the outer surface of the first peripheral wall section to the through hole in the second peripheral wall section.

2. The electromagnetic relay according to claim 1, wherein the flow path includes a wall section disposed in the case.

3. The electromagnetic relay according to claim 2, wherein the case includes a base including the first peripheral wall section and having an opening, and a cover covering the opening, the base includes a first wall section forming the wall section, and the cover includes a second wall section forming the wall section.

4. The electromagnetic relay according to claim 3, wherein the first wall section faces the second wall section with a space provided therebetween.

5. The electromagnetic relay according to claim 4, wherein the case has a storage space adjacent to a part of the terminal accommodated in the case and stores the sealant.

6. The electromagnetic relay according to claim 5, wherein the storage space is located in the case.

7. The electromagnetic relay according to claim 5, wherein the case includes a projection protruding from the second peripheral wall section, and the storage space has a space in communication with the through hole and surrounded by the projection.

8. The electromagnetic relay according to claim 3, wherein the case has a storage space adjacent to a part of the terminal accommodated in the case and stores the sealant.

9. The electromagnetic relay according to claim 8, wherein the storage space is located in the case.

10. The electromagnetic relay according to claim 8, wherein the case includes a projection protruding from the second peripheral wall section, and the storage space has a space in communication with the through hole and surrounded by the projection.

11. The electromagnetic relay according to claim 3, wherein the case includes a window adjacent to the through hole in the second peripheral wall section.

12. The electromagnetic relay according to claim 2, wherein the case has a storage space adjacent to a part of the terminal accommodated in the case and stores the sealant.

13. The electromagnetic relay according to claim 12, wherein the storage space is located in the case.

14. The electromagnetic relay according to claim 12, wherein the case includes a projection protruding from the second peripheral wall section, and the storage space has a space in communication with the through hole and surrounded by the projection.

15. The electromagnetic relay according to claim 2, wherein the case includes a window adjacent to the through hole in the second peripheral wall section.

16. The electromagnetic relay according to claim 1, wherein the flow path is located at an outer surface of the second peripheral wall section outside the case and communicates with the through hole of the second peripheral wall section.

17. The electromagnetic relay according to claim 1, wherein the case has a storage space adjacent to a part of the terminal accommodated in the case and stores the sealant.

18. The electromagnetic relay according to claim 17, wherein the storage space is located in the case.

19. The electromagnetic relay according to claim 17, wherein the case includes a projection protruding from the second peripheral wall section, and the storage space has a space in communication with the through hole and surrounded by the projection.

20. The electromagnetic relay according to claim 1, wherein the case includes a window adjacent to the through hole in the second peripheral wall section.

* * * * *